US009497542B2

(12) United States Patent
Tanaka et al.

(10) Patent No.: US 9,497,542 B2
(45) Date of Patent: Nov. 15, 2016

(54) SIGNAL PROCESSING SYSTEM AND SIGNAL PROCESSING METHOD

(71) Applicant: YAMAHA CORPORATION, Hamamatsu (JP)

(72) Inventors: Ryo Tanaka, Hamamatsu (JP); Koichiro Sato, Hamamatsu (JP); (Continued)

(73) Assignee: YAMAHA CORPORATION, Hamamatsu-shi (JP)

( * ) Notice: Subject to any disclaimer, the term of this patent is extended or adjusted under 35 U.S.C. 154(b) by 145 days.

(21) Appl. No.: 14/077,496

(22) Filed: Nov. 12, 2013

(65) Prior Publication Data

US 2014/0133666 A1 May 15, 2014

(30) Foreign Application Priority Data

Nov. 12, 2012 (JP) ..... 2012-248158
Nov. 13, 2012 (JP) ..... 2012-249607
Nov. 13, 2012 (JP) ..... 2012-249609

(51) Int. Cl.
*H04R 3/00* (2006.01)
*H04R 3/12* (2006.01)
*H04R 3/02* (2006.01)

(52) U.S. Cl.
CPC ..... *H04R 3/00* (2013.01); *H04R 3/005* (2013.01); *H04R 3/02* (2013.01); *H04R 3/12* (2013.01);
(Continued)

(58) Field of Classification Search
CPC ..... H04R 3/00; H04R 3/005; H04R 2410/01
(Continued)

(56) References Cited

U.S. PATENT DOCUMENTS 4,993,073 A 2/1991 Sparkes
5,479,421 A 12/1995 Takebe
(Continued)

FOREIGN PATENT DOCUMENTS

EP 1482763 A2 12/2004
EP 1667486 A2 6/2006
(Continued)

OTHER PUBLICATIONS

Office Action issued in Canadian Appln. No. 2,832,848 dated Apr. 22, 2015.
(Continued)

*Primary Examiner* — Disler Paul
(74) *Attorney, Agent, or Firm* — Rossi, Kimms & McDowell LLP

(57) ABSTRACT

A signal processing system includes microphone units connected in series and a host device connected to one of the microphone units. Each of the microphone units has a microphone, a temporary storage memory, and a processing section for processing the sound picked up by the microphone. The host device has a non-volatile memory in which a sound signal processing program for the microphone units is stored. The host device transmits the sound signal processing program read from the non-volatile memory to each of the microphone units. Each of the microphone units temporarily stores the sound signal processing program in the temporary storage memory. The processing section performs a process corresponding to the sound signal processing program temporarily stored in the temporary storage memory and transmits the processed sound to the host device.

12 Claims, 23 Drawing Sheets

(72) Inventors: Yoshifumi Oizumi, Hamamatsu (JP); Takayuki Inoue, Hamamatsu (JP)

(52) U.S. Cl.
CPC ..... *H04R 2410/01* (2013.01); *H04R 2410/05* (2013.01)

(58) Field of Classification Search
USPC ..... 381/92, 122, 59–60, 66
See application file for complete search history.

(56) References Cited

U.S. PATENT DOCUMENTS

| | | | | |
|---|---|---|---|---|
| 6,785,394 | B1 * | 8/2004 | Olsen | H04R 25/505 381/312 |
| 7,804,965 | B2 * | 9/2010 | Kawaguchi | H04N 7/147 381/122 |
| 8,335,311 | B2 | 12/2012 | Sudo | |
| 8,712,082 | B2 * | 4/2014 | Spieler | 381/23.1 |
| 2002/0031233 | A1 * | 3/2002 | Ueshima | G10H 1/361 381/61 |
| 2004/0240676 | A1 | 12/2004 | Hashimoto et al. | |
| 2005/0254640 | A1 | 11/2005 | Ohki et al. | |
| 2006/0104457 | A1 * | 5/2006 | Kawaguchi | H04N 7/147 381/91 |
| 2009/0156162 | A1 | 6/2009 | Satou | |
| 2011/0082690 | A1 * | 4/2011 | Togami | H04R 1/406 704/201 |
| 2011/0165947 | A1 | 7/2011 | Satou | |
| 2011/0188684 | A1 * | 8/2011 | Spieler | G06F 8/65 381/315 |
| 2012/0130517 | A1 | 5/2012 | Chiu et al. | |
| 2012/0155671 | A1 * | 6/2012 | Suzuki | H04M 9/08 381/77 |
| 2013/0343566 | A1 * | 12/2013 | Triplett | H04N 21/23406 381/77 |

FOREIGN PATENT DOCUMENTS

| | | | |
|---|---|---|---|
| JP | 3-201636 | A | 9/1991 |
| JP | 09-083988 | A | 3/1997 |
| JP | 10-276415 | A | 10/1998 |
| JP | 2002-190870 | A | 7/2002 |
| JP | 2004-242207 | A | 8/2004 |
| JP | 2006-140930 | A | 6/2006 |
| JP | 2007-60644 | A | 3/2007 |
| JP | 3972921 | B2 | 6/2007 |
| JP | 2008-147823 | A | 6/2008 |
| WO | 2006-054778 | A1 | 5/2006 |

OTHER PUBLICATIONS

International Search Report issued in PCT/JP2013/080587, dated Feb. 18, 2014. Form PCT/ISA/210 (English translation provided) and PCT/ISA/237.

Australian Office Action issued in Australian counterpart application No. AU2013342412, dated Jun. 29, 2015.

Office Action issued in KR10-2015-7001712, mailed Nov. 14, 2015. English translation provided.

Extended European Search Report issued in European Appln. No. 13853867.3 mailed Feb. 11, 2016.

Office Action issued in Canadian Appin. No. 2,832,848 mailed Mar. 14, 2016.

"Field-programmable gate array", Wikipedia, the free encyclopedia, May 4, 2012, 12 pages, URL:https://en.wikipedia.org/w/index.php?title=Field-programmable_gate_array&oldid=490555359, XP055240775. Retrieved on Jan. 13, 2016.

Office Action issued in Korean Appln. No. 10-2015-7001712 mailed May 2, 2016. English translation provided.

Office Action issued in Chinese Patent Application No. CN201310560237.0, mailed Jul. 28, 2016. English translation provided.

* cited by examiner

FIG. 16

| | | |
|---|---|---|
| DH | $Sm_{10A}$ | $IFo_{10A}$ |

SIGNAL PROCESSING SYSTEM AND SIGNAL PROCESSING METHOD

BACKGROUND

The present invention relates to a signal processing system composed of microphone units and a host device connected to the microphone units.

Conventionally, in a teleconference system, an apparatus has been proposed in which a plurality of programs have been stored so that an echo canceling program can be selected depending on a communication destination.

For example, in an apparatus according to JP-A-2004-242207, the tap length thereof is changed depending on a communication destination.

Furthermore, in a videophone apparatus according to JP-A-10-276415, a program different for each use is read by changing the settings of a DIP switch provided on the main body thereof.

However, in the apparatuses according to JP-A-2004-242207 and JP-A-10-276415, a plurality of programs must be stored in advance depending on the mode of anticipated usage. If a new function is added, program rewriting is necessary, this causes a problem in particular in the case that the number of terminals increases.

SUMMARY

Accordingly, the present invention is intended to provide a signal processing system in which a plurality of programs are not required to be stored in advance.

In order to achieve the above object, according to the present invention, there is provided a signal processing system according to the present invention, comprising:

a plurality of microphone units configured to be connected in series;

each of the microphone units having a microphone for picking up sound, a temporary storage memory, and a processing section for processing the sound picked up by the microphone;

a host device configured to be connected to one of the microphone units, the host device having a non-volatile memory in which a sound signal processing program for the microphone units is stored;

the host device transmitting the sound signal processing program read from the non-volatile memory to each of the microphone units; and each of the microphone units temporarily storing the sound signal processing program in the temporary storage memory, wherein the processing section performs a process corresponding to the sound signal processing program temporarily stored in the temporary storage memory and transmits the processed sound to the host device.

As described above, in the signal processing system, no operation program is stored in advance in the terminals (microphone units), but each microphone unit receives a program from the host device and temporarily stores the program and then performs operation. Hence, it is not necessary to store numerous programs in the microphone unit in advance. Furthermore, in the case that a new function is added, it is not necessary to rewrite the program of each microphone unit. The new function can be achieved by simply modifying the program stored in the non-volatile memory on the side of the host device.

In the case that a plurality of microphone units are connected, the same program may be executed in all the microphone units, but an individual program can be executed in each microphone unit.

With the present invention, a plurality of programs are not required to be stored in advance, and in the case that a new function is added, it is not necessary to rewrite the program of a terminal.

BRIEF DESCRIPTION OF THE DRAWINGS

FIG. 16 is a view showing an example of the data format of extension unit data;

DETAILED DESCRIPTION OF EXEMPLARY EMBODIMENTS

Figure 1:
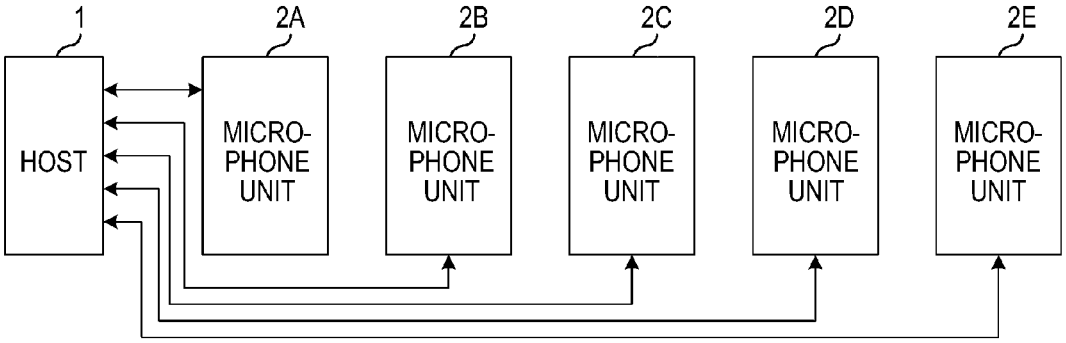
FIG. 1 is a view showing a connection mode of a signal processing system according to the present invention.

FIG. 1 is a view showing a connection mode of a signal processing system according to the present invention. The signal processing system includes a host device 1 and a plurality (five in this example) of microphone units 2A to 2E respectively connected to the host device 1.

The microphone units 2A to 2E are respectively disposed, for example, in a conference room with a large space. The host device 1 receives sound signals from the respective microphone units and carries out various processes. For example, the host device 1 individually transmits the sound signals of the respective microphone units to another host device connected via a network.

Figure 2A:
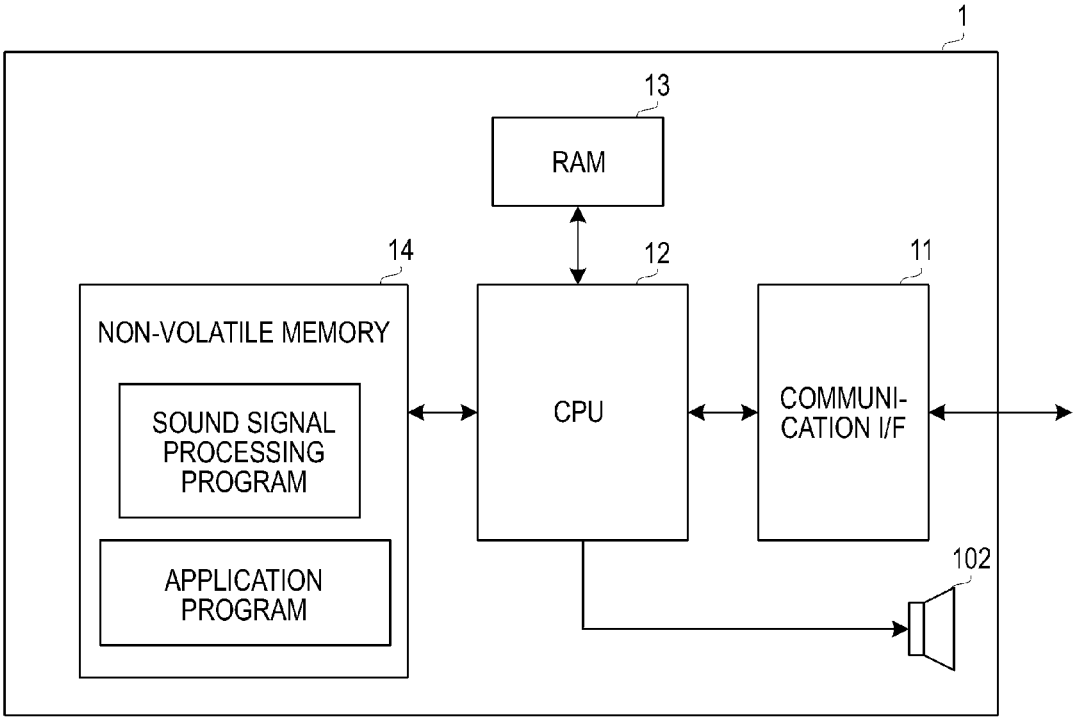
FIG. 2A is a block diagram showing the configuration of a host device.
Figure 2B:
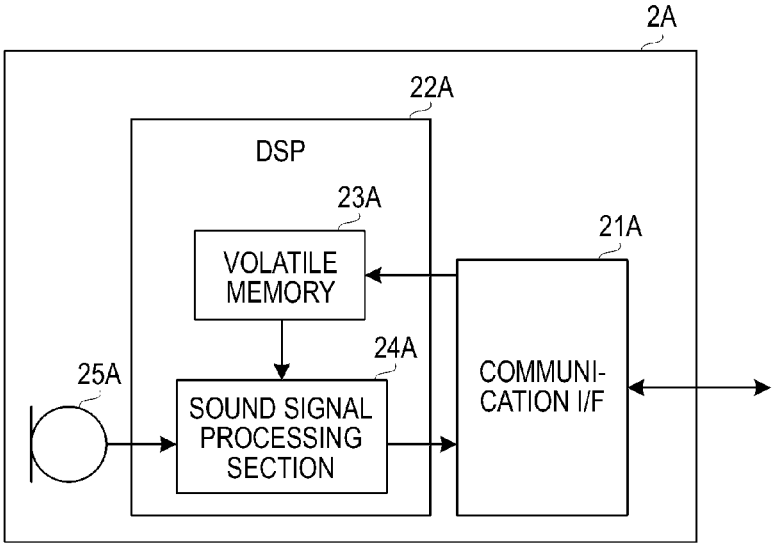
FIG. 2B is a block diagram showing the configuration of a microphone unit.

FIG. 2A is a block diagram showing the configuration of the host device 1, and FIG. 2B is a block diagram showing the configuration of the microphone unit 2A. Since all the respective microphone units have the same hardware configuration, the microphone unit 2A is shown as a representative in FIG. 2B, and the configuration and functions thereof are described. However, in this embodiment, the configuration of A/D conversion is omitted, and the following description is given assuming that various signals are digital signals, unless otherwise specified.

As shown in FIG. 2A, the host device 1 has a communication interface (I/F) 11, a CPU 12, a RAM 13, a non-volatile memory 14 and a speaker 102.

The CPU 12 reads application programs from the non-volatile memory 14 and stores them in the RAM 13 temporarily, thereby performing various operations. For example, as described above, the CPU 12 receives sound signals from the respective microphone units and transmits the respective signals individually to another host device connected via a network.

The non-volatile memory 14 is composed of a flash memory, a hard disk drive (HDD) or the like. In the non-volatile memory 14, sound processing programs (hereafter referred to as sound signal processing programs in this embodiment) are stored. The sound signal processing programs are programs for operating the respective microphone units. For example, various kinds of programs, such as a program for achieving an echo canceller function, a program for achieving a noise canceller function, and a program for achieving gain control, are included in the programs.

The CPU 12 reads a predetermined sound signal processing program from the non-volatile memory 14 and transmits the program to each microphone unit via the communication I/F 11. The sound signal processing programs may be built in the application programs.

The microphone unit 2A has a communication I/F 21A, a DSP 22A and a microphone (hereafter sometimes referred to as a mike) 25A.

The DSP 22A has a volatile memory 23A and a sound signal processing section 24A. Although a mode in which the volatile memory 23A is built in the DSP 22A is shown in this example, the volatile memory 23A may be provided separately from the DSP 22A. The sound signal processing section 24A serves as a processing section according to the present invention and has a function of outputting the sound picked up by the microphone 25A as a digital sound signal.

The sound signal processing program transmitted from the host device 1 is temporarily stored in the volatile memory 23A via the communication I/F 21A. The sound signal processing section 24A performs a process corresponding to the sound signal processing program temporarily stored in the volatile memory 23A and transmits a digital sound signal relating to the sound picked up by the microphone 25A to the host device 1. For example, in the case that an echo canceller program is transmitted from the host device 1, the sound signal processing section 24A removes the echo component from the sound picked up by the microphone 25A and transmits the processed signal to the host device 1. This method in which the echo canceller program is executed in each microphone unit is preferably suitable in the case that an application program for teleconference is executed in the host device 1.

The sound signal processing program temporarily stored in the volatile memory 23A is erased in the case that power supply to the microphone unit 2A is shut off. At each start time, the microphone unit surely receives the sound signal processing program for operation from the host device 1 and then performs operation. In the case that the microphone unit 2A is a type that receives power supply (bus power driven) via the communication I/F 21A, the microphone unit 2A receives the program for operation from the host device 1 and performs operation only when connected to the host device 1.

As described above, in the case that an application program for teleconferences is executed in the host device 1, a sound signal processing program for echo canceling is executed. Also, in the case that an application program for recording is executed, a sound signal processing program for noise canceling is executed. On the other hand, it is also possible to use a mode in which in the case that an application program for sound amplification is executed so that the sound picked up by each microphone unit is output from the speaker 102 of the host device 1, a sound signal processing program for acoustic feedback canceling is executed. In the case that the application program for recording is executed in the host device 1, the speaker 102 is not required.

Figure 3A:
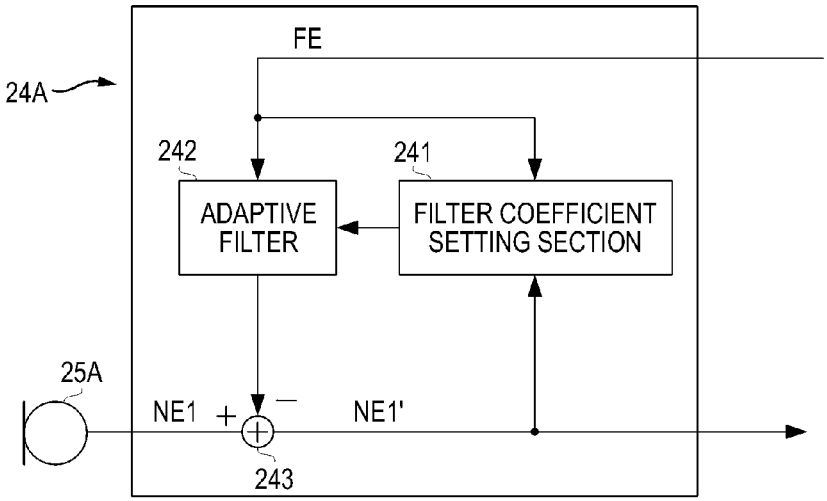
FIG. 3A is a view showing the configuration of an echo canceller.

An echo canceller will be described referred to FIG. 3A. FIG. 3A is a block diagram showing a configuration in the case that the sound signal processing section 24A executes the echo canceller program. As shown in FIG. 3A, the sound signal processing section 24A is composed of a filter coefficient setting section 241, an adaptive filter 242 and an addition section 243.

The filter coefficient setting section 241 estimates the transfer function of an acoustic transmission system (the sound propagation route from the speaker 102 of the host device 1 to the microphone of each microphone unit) and sets the filter coefficient of the adaptive filter 242 using the estimated transfer function.

The adaptive filter 242 includes a digital filter, such as an FIR filter. From the host device 1, the adaptive filter 242 receives a radiation sound signal FE to be input to the speaker 102 of the host device 1 and performs filtering using the filter coefficient set in the filter coefficient setting section 241, thereby generating a pseudo-regression sound signal. The adaptive filter 242 outputs the generated pseudo-regression sound signal to the addition section 243.

The addition section 243 outputs a sound pick-up signal NE1' obtained by subtracting the pseudo-regression sound signal input from the adaptive filter 242 from the sound pick-up signal NE1 of the microphone 25A.

On the basis of the radiation sound FE and the sound pick-up signal NE1' output from the addition section 243, the filter coefficient setting section 241 renews the filter coefficient using an adaptive algorithm, such as an LMS algorithm. Then, the filter coefficient setting section 241 sets the renewed filter coefficient to the adaptive filter 242.

Figure 3B:
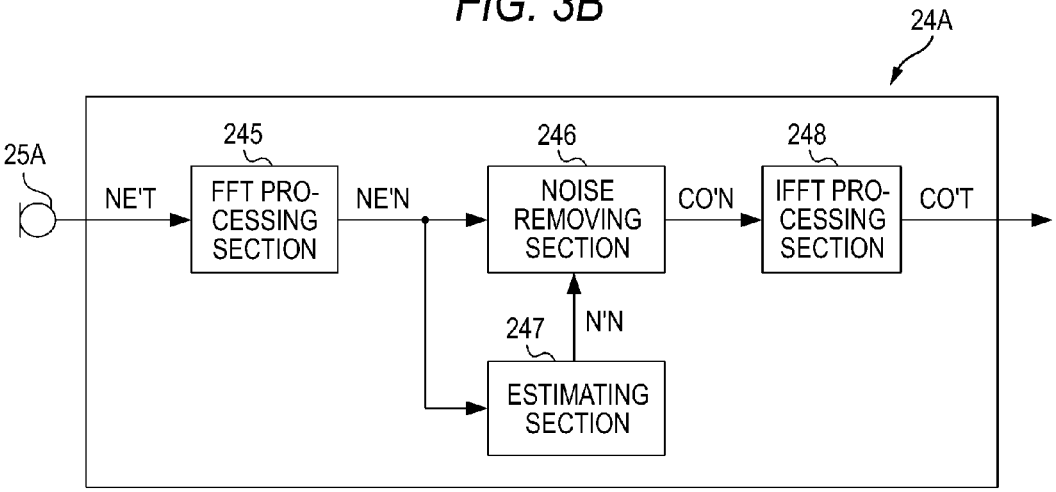
FIG. 3B is a view showing the configuration of a noise canceller.

Next, a noise canceller will be described referring to FIG. 3B. FIG. 3B is a block diagram showing the configuration of the sound signal processing section 24A in the case that the processing section executes the noise canceller program. As shown in FIG. 3B, the sound signal processing section 24A is composed of an FFT processing section 245, a noise removing section 246, an estimating section 247 and an IFFT processing section 248.

The FFT processing section 245 for executing a Fourier transform converts a sound pick-up signal NE'T into a frequency spectrum NE'N. The noise removing section 246 removes the noise component N'N contained in the frequency spectrum NE'N. The noise component N'N is estimated on the basis of the frequency spectrum NE'N by the estimating section 247.

The estimating section 247 performs a process for estimating the noise component N'N contained in the frequency spectrum NE'N input from the FFT processing section 245. The estimating section 247 sequentially obtains the frequency spectrum (hereafter referred to as the sound spectrum) S(NE'N) at a certain sampling timing of the sound signal NE'N and temporarily stores the spectrum. On the basis of the sound spectra S(NE'N) obtained and stored a plurality of times, the estimating section 247 estimates the frequency spectrum (hereafter referred to as the noise spectrum) S(N'N) at a certain sampling timing of the noise component N'N. Then, the estimating section 247 outputs the estimated noise spectrum S(N'N) to the noise removing section 246.

For example, it is assumed that the noise spectrum at a certain sampling timing T is S(N'N(T)), that the sound spectrum at the same sampling timing T is S(NE'N(T)), and that the noise spectrum at the preceding sampling timing T−1 is S(N'N(T−1)). Furthermore, α and β are forgetting constants; for example, α=0.9 and β=0.1. The noise spectrum S(N'N(T)) can be represented by the following expression 1.

$$S(N'N(T))=\alpha S(N'N(T-1))+\beta S(N'N(T)) \quad \text{Expression 1}$$

A noise component, such as background noise, can be estimated by estimating the noise spectrum S(N'N(T)) on the basis of the sound spectrum. It is assumed that the estimating section 247 performs a noise spectrum estimating process only in the case that the level of the sound pick-up signal picked up by the microphone 25A is low (silent).

The noise removing section 246 removes the noise component N'N from the frequency spectrum NE'N input from the FFT processing section 245 and outputs the frequency spectrum CO'N obtained after the noise removal to the IFFT processing section 248. More specifically, the noise removing section 246 calculates the ratio of the signal levels of the sound signal S(NE'N) and the noise spectrum S(N'N) input from the estimating section 247. The noise removing section 246 linearly outputs the sound spectrum S(NE'N) in the case that the calculated ratio of the signal levels is equal to a threshold value or more. In addition, the noise removing section 246 nonlinearly outputs the sound spectrum S(NE'N) in the case that the calculated ratio of the signal levels is less than the threshold value.

The IFFT processing section 248 for executing an inverse Fourier transform inversely converts the frequency spectrum CO'N after the removal of the noise component N' N on the time axis and outputs a generated sound signal CO'T.

Figure 4:
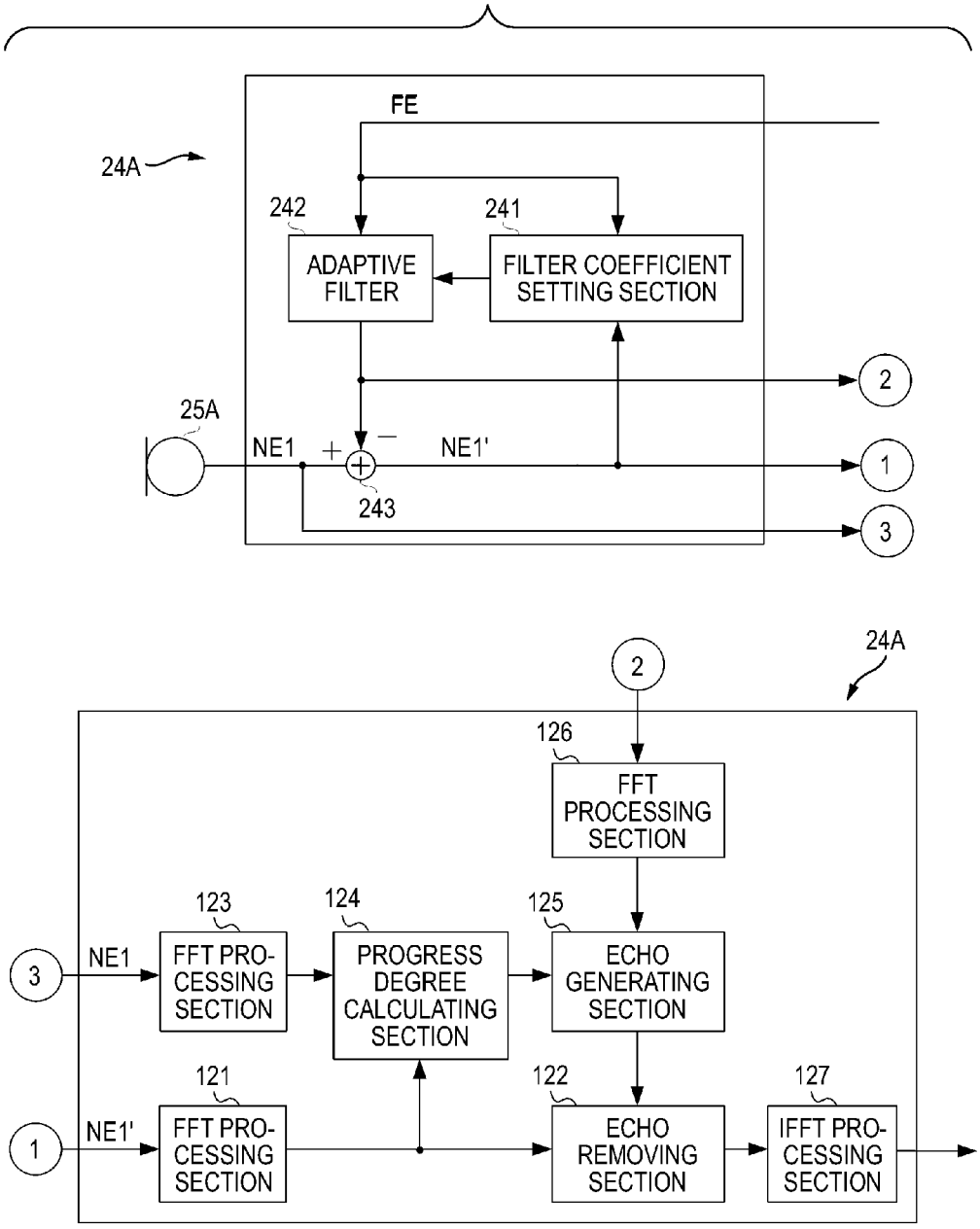
FIG. 4 is a view showing the configuration of an echo suppressor.

Furthermore, the sound signal processing program can achieve a program for such an echo suppressor as shown in FIG. 4. This echo suppressor is used to remove the echo component that was unable to be removed by the echo canceller at the subsequent stage thereof shown in FIG. 3A. The echo suppressor is composed of an FFT processing section 121, an echo removing section 122, an FFT processing section 123, a progress degree calculating section 124, an echo generating section 125, an FFT processing section 126 and an IFFT processing section 127 as shown in FIG. 4.

The FFT processing section 121 is used to convert the sound pick-up signal NE1' output from the echo canceller into a frequency spectrum. This frequency spectrum is output to the echo removing section 122 and the progress degree calculating section 124. The echo removing section 122 removes the residual echo component (the echo component that was unable to be removed by the echo canceller) contained in the input frequency spectrum. The residual echo component is generated by the echo generating section 125.

The echo generating section 125 generates the residual echo component on the basis of the frequency spectrum of the pseudo-regression sound signal input from the FFT processing section 126. The residual echo component is obtained by adding the residual echo component estimated in the past to the frequency spectrum of the input pseudo-regression sound signal multiplied by a predetermined coefficient. This predetermined coefficient is set by the progress degree calculating section 124. The progress degree calculating section 124 obtains the power ratio (ERLE: Echo Return Loss Enhancement) of the sound pick-up signal NE1 (the sound pick-up signal before the echo component is removed by the echo canceller at the preceding stage) input from the FFT processing section 123 and the sound pick-up signal NE1' (the sound pick-up signal after the echo component was removed by the echo canceller at the preceding stage) input from the FFT processing section 121. The progress degree calculating section 124 outputs a predetermined coefficient based on the power ratio. For example, in the case that the learning of the adaptive filter 242 has not been performed at all, the above-mentioned predetermined coefficient is set to 1; in the case that the learning of the adaptive filter 242 has proceeded, the predetermined coefficient is set to 0; as the learning of the adaptive filter 242 proceeds further, the predetermined coefficient is made smaller, and the residual echo component is made smaller. Then, the echo removing section 122 removes the residual echo component calculated by the echo generating section 125. The IFFT processing section 127 inversely converts the frequency spectrum after the removal of the echo component on the time axis and outputs the obtained sound signal.

The echo canceller program, the noise canceller program and the echo suppressor program can be executed by the host device 1. In particular, it is possible that while each microphone unit executes the echo canceller program, the host device executes the echo suppressor program.

In the signal processing system according to this embodiment, the sound signal processing program to be executed can be modified depending on the number of the microphone units to be connected. For example, in the case that the number of microphone units to be connected is one, the gain of the microphone unit is set high, and in the case that the number of microphone units to be connected is plural, the gains of the respective microphone units are set relatively low.

On the other hand, in the case that each microphone unit has a plurality of microphones, it is also possible to use a mode in which a program for making the microphones to function as a microphone array is executed. In this case, different parameters (gain, delay amount, etc.) can be set to each microphone unit depending on the order (positions) of the microphone units to be connected to the host device 1.

In this way, the microphone unit according to this embodiment can achieve various kinds of functions depending on the usage of the host device 1. Even in the case that these various kinds of functions are achieved, it is not necessary to store programs in advance in the microphone unit 2A, whereby no non-volatile memory is necessary (or the capacity thereof can be made small).

Although the volatile memory 23A, a RAM, is taken as an example of the temporary storage memory in this embodiment, the memory is not limited to a volatile memory, provided that the contents of the memory are erased in the case that power supply to the microphone unit 2A is shut off, and a non-volatile memory, such as a flash memory, may also be used. In this case, the DSP 22A erases the contents of the flash memory, for example, in the case that power supply to the microphone unit 2A is shut off or in the case that cable replacement is performed. In this case, however, a capacitor or the like is provided to temporarily maintain power source when power supply to the microphone unit 2A is shut off until the DSP 22A erases the contents of the flash memory.

Furthermore, in the case that a new function that was not supposed to be used at the time of the sale of the product is added, it is not necessary to rewrite the program of each microphone unit. The new function can be achieved by simply modifying the sound signal processing program stored in the non-volatile memory 14 of the host device 1.

Moreover, since all the microphone units 2A to 2E have the same hardware, the user is not required to be conscious of which microphone unit should be connected to which position.

For example, in the case that the echo canceller program is executed in the microphone unit (for example, the microphone unit 2A) closest to the host device 1 and that the noise canceller program is executed in the microphone unit (for example, the microphone unit 2E) farthest from the host device 1, if the connections of the microphone unit 2A and the microphone unit 2E are exchanged, the echo canceller program is surely executed in the microphone unit 2E closest to the host device 1, and the noise canceller program is executed in the microphone unit 2A farthest from the host device 1.

As shown in FIG. 1, a star connection mode in which the respective microphone units are directly connected to the host device 1 may be used. However, as shown in FIG. 5A, a cascade connection mode in which the microphone units are connected in series and either one (the microphone unit 2A) of them is connected to the host device 1 may also be used.

Figure 5A:
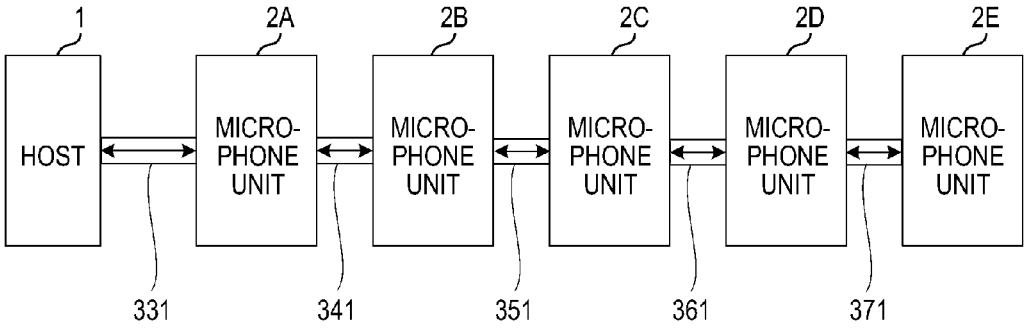
FIG. 5A is a view showing another connection mode of the signal processing system according to the present invention.

In the example shown in FIG. 5A, the host device 1 is connected to the microphone unit 2A via a cable 331. The microphone unit 2A is connected to the microphone unit 2B via a cable 341. The microphone unit 2B is connected to the microphone unit 2C via a cable 351. The microphone unit 2C is connected to the microphone unit 2D via a cable 361. The microphone unit 2D is connected to the microphone unit 2E via a cable 371.

Figure 5B:
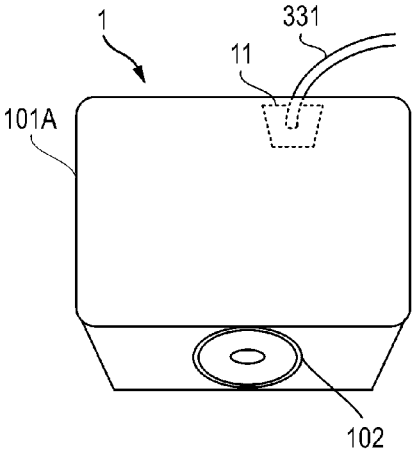
FIG. 5B is an external perspective view showing the host device.
Figure 5C:
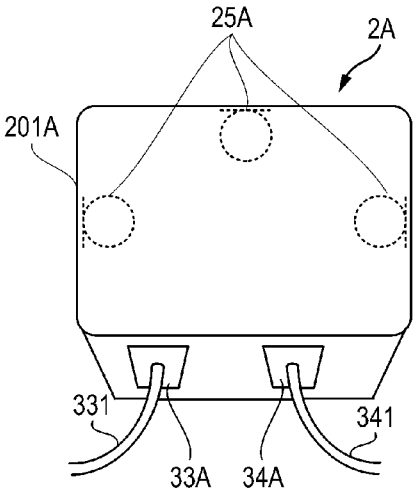
FIG. 5C is an external perspective view showing the microphone unit.

FIG. 5B is an external perspective view showing the host device 1, and FIG. 5C is an external perspective view showing the microphone unit 2A. In FIG. 5C, the microphone unit 2A is shown as a representative and is described below; however, all the microphone units have the same external appearance and configuration. As shown in FIG. 5B, the host device 1 has a rectangular parallelepiped housing 101A, the speaker 102 is provided on a side face (front face) of the housing 101A, and the communication I/F 11 is provided on a side face (rear face) of the housing 101A. The microphone unit 2A has a rectangular parallelepiped housing 201A, the microphones 25A are provided on side faces of the housing 201A, and a first input/output terminal 33A and a second input/output terminal 34A are provided on the front face of the housing 201A. FIG. 5C shows an example in which the microphones 25A are provided on the rear face, the right side face and the left side face, thereby having three sound pick-up directions. However, the sound pick-up directions are not limited to those used in this example. For example, it may be possible to use a mode in which the three microphones 25A are arranged at 120 degree intervals in a planar view and sound pickup is performed in a circumferential direction. The cable 331 is connected to the first input/output terminal 33A, whereby the microphone unit 2A is connected to the communication I/F 11 of the host device 1 via the cable 331. Furthermore, the cable 341 is connected to the second input/output terminal 34A, whereby the microphone unit 2A is connected to the first input/output terminal 33B of the microphone unit 2B via the cable 341. The shapes of the housing 101A and the housing 201A are not limited to a rectangular parallelepiped shape. For example, the housing 101 of the host device 1 may have an elliptic cylindrical shape and the housing 201A may have a cylindrical shape.

Although the signal processing system according to this embodiment has the cascade connection mode shown in FIG. 5A in appearance, the system can achieve a star connection mode electrically. This will be described below.

Figure 6A:
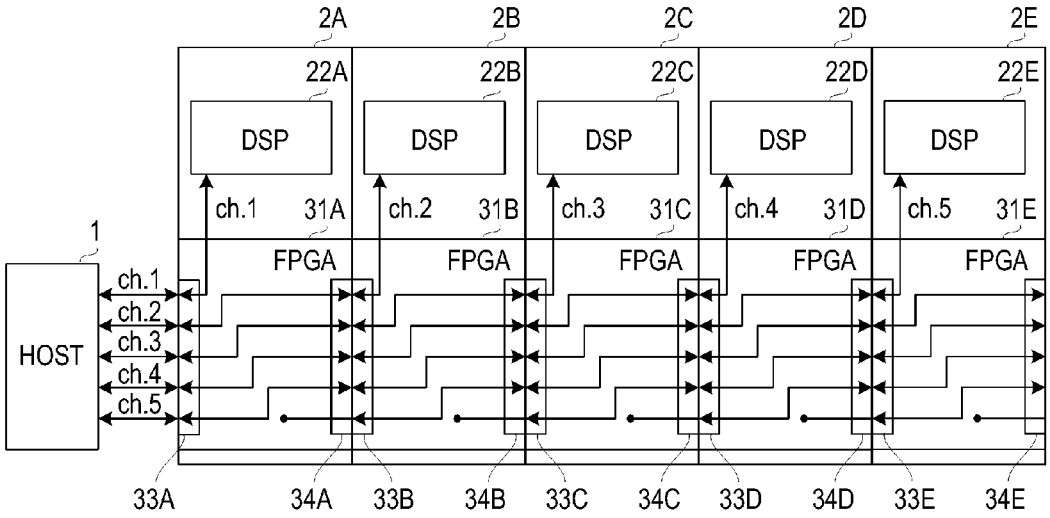
FIG. 6A is a schematic block diagram showing signal connections.

FIG. 6A is a schematic block diagram showing signal connections. The microphone units have the same hardware configuration. First, the configuration and function of the microphone unit 2A as a representative will be described below by referring to FIG. 6B.

The microphone unit 2A has an FPGA 31A, the first input/output terminal 33A and the second input/output terminal 34A in addition to the DSP 22A shown in FIG. 2A.

Figure 6B:
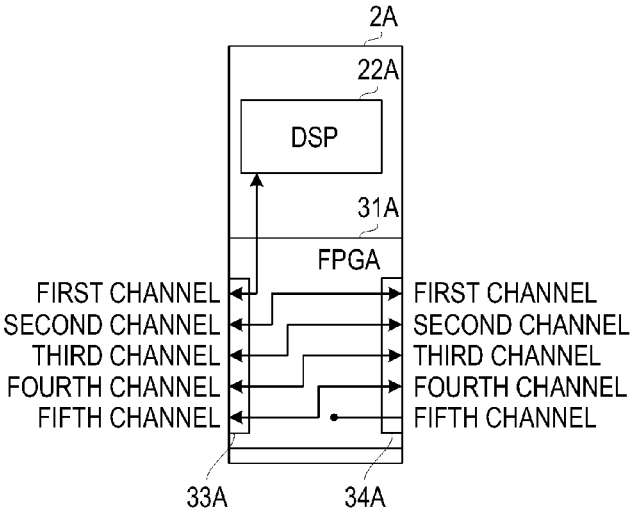
FIG. 6B is a schematic block diagram showing the configuration of the microphone unit.

The FPGA 31A achieves such a physical circuit as shown in FIG. 6B. In other words, the FPGA 31A is used to physically connect the first channel of the first input/output terminal 33A to the DSP 22A.

Furthermore, the FPGA 31A is used to physically connect one of sub-channels other than the first channel of the first input/output terminal 33A to another channel adjacent to the channel of the second input/output terminal 34A and corresponding to the sub-channel. For example, the second channel of the first input/output terminal 33A is connected to the first channel of the second input/output terminal 34A, the third channel of the first input/output terminal 33A is connected to the second channel of the second input/output terminal 34A, the fourth channel of the first input/output terminal 33A is connected to the third channel of the second input/output terminal 34A, and the fifth channel of the first input/output terminal 33A is connected to the fourth channel of the second input/output terminal 34A. The fifth channel of the second input/output terminal 34A is not connected anywhere.

With this kind of physical circuit, the signal (ch.1) of the first channel of the host device 1 is input to the DSP 22A of the microphone unit 2A. In addition, as shown in FIG. 6A, the signal (ch.2) of the second channel of the host device 1 is input from the second channel of the first input/output terminal 33A of the microphone unit 2A to the first channel of the first input/output terminal 33B of the microphone unit 2B and then input to the DSP 22B of the microphone unit 2B.

The signal (ch.3) of the third channel is input from the third channel of the first input/output terminal 33A to the first channel of the first input/output terminal 33C of the microphone unit 2C via the second channel of the first input/output terminal 33B of the microphone unit 2B and then input to the DSP 22C of the microphone unit 2C.

Because of the similarity in structure, the sound signal (ch.4) of the fourth channel is input from the fourth channel of the first input/output terminal 33A to the first channel of the first input/output terminal 33D of the microphone unit 2D via the third channel of the first input/output terminal 33B of the microphone unit 2B and the second channel of the first input/output terminal 33C of the microphone unit 2C and then input to the DSP 22D of the microphone unit 2D. The sound signal (ch.5) of the fifth channel is input from the fifth channel of the first input/output terminal 33A to the first channel of the first input/output terminal 33E of the microphone unit 2E via the fourth channel of the first input/output terminal 33B of the microphone unit 2B, the third channel of the first input/output terminal 33C of the microphone unit 2C and the second channel of the first input/output terminal 33D of the microphone unit 2D and then input to the DSP 22E of the microphone unit 2E.

With this configuration, individual sound signal processing programs can be transmitted from the host device 1 to the respective microphone units although the connection is a cascade connection in appearance. In this case, the microphone units being connected in series via the cables can be connected and disconnected as desired, and it is not necessary to give any consideration to the order of the connection. For example, in the case that the echo canceller program is transmitted to the microphone unit 2A closest to the host device 1 and that the noise canceller program is transmitted to the microphone unit 2E farthest from the host device 1, if the connection positions of the microphone unit 2A and the microphone unit 2E are exchanged, programs to be transmitted to the respective microphone units will be described below. In this case, the first input/output terminal 33E of the microphone unit 2E is connected to the communication UF 11 of the host device 1 via the cable 331, and the second input/output terminal 34E is connected to the first input/output terminal 33B of the microphone unit 2B via the cable 341. The first input/output terminal 33A of the microphone unit 2A is connected to the second input/output terminal 34D of the microphone unit 2D via the cable 371. As a result, the echo canceller program is transmitted to the microphone unit 2E, and the noise canceller program is transmitted to the microphone unit 2A. Even if the order of the connection is exchanged as described above, the echo canceller program is executed in the microphone unit closest to the host device 1, and the noise canceller program is executed in the microphone unit farthest from the host device 1.

Under the recognition of the order of the connection of the respective microphone units and on the basis of the order of the connection and the lengths of the cables, the host device 1 can transmit the echo canceller program to the microphone units located within a certain distance from the host device and can transmit the noise canceller program to the microphone units located outside the certain distance. With respect to the lengths of the cables, for example, in the case that dedicated cables are used, the information regarding the lengths of the cables is stored in the host device in advance. Furthermore, it is possible to know the length of each cable being used by setting identification information to each cable, by storing the identification information and information relating to the length of the cable and by receiving the identification information via each cable being used.

When the host device 1 transmits the echo canceller program, it is preferable that the number of filter coefficients (the number of taps) should be increased for the echo canceller located close to the host device so as to cope with echoes with long reverberation and that the number of filter coefficients (the number of taps) should be decreased for the echo canceller located away from the host device.

Furthermore, even in the case that an echo component that cannot be removed by the echo suppressor is generated, it is possible to achieve a mode for removing the echo component by transmitting a nonlinear processing program (for example, the above-mentioned echo suppressor program), instead of the echo canceller program, to the microphone units within the certain distance from the host device. Moreover, although it is described in this embodiment that the microphone unit selects the noise canceller or the echo canceller, It may be possible that both the noise canceller and echo canceller programs are transmitted to the microphone units close to the host device 1 and that only the noise canceller program is transmitted to the microphone units away from the host device 1.

With the configuration shown in FIGS. 6A and 6B, also in the case that sound signals are output from the respective microphone units to the host device 1, the sound signals of the respective channels can be output individually from the respective microphone units.

In addition, in this example, an example in which a physical circuit is achieved using the FPGA has been described. However, without being limited to the FPGA, any device may be used, provided that the device can achieve the above-mentioned physical circuit. For example, a dedicated IC may be prepared in advance or wiring may be done in advance. Furthermore, without being limited to the physical circuit, a mode capable of achieving a circuit similar to that of the FPGA 31A may be implemented by software.

Figure 7:
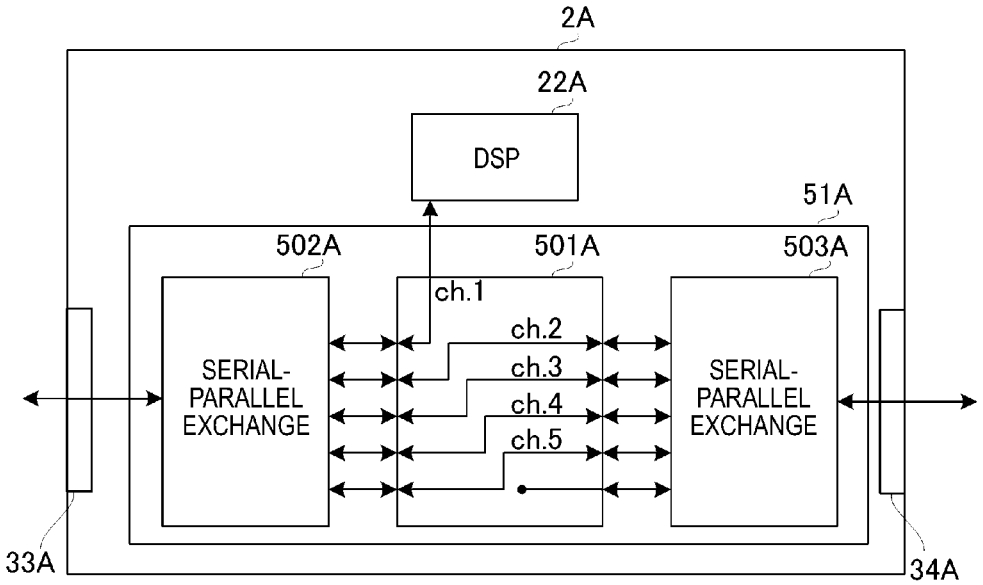
FIG. 7 is a schematic block diagram showing the configuration of a signal processing unit for performing conversion between serial data and parallel data.

Next, FIG. 7 is a schematic block diagram showing the configuration of a microphone unit for performing conversion between serial data and parallel data. In FIG. 7, the microphone unit 2A is shown as a representative and described. However, all the microphone units have the same configuration and function.

In this example, the microphone unit 2A has an FPGA 51A instead of the FPGA 31A shown in FIGS. 6A and 6B.

The FPGA 51A has a physical circuit 501A corresponding to the above-mentioned FPGA 31A, a first conversion section 502A and a second conversion section 503A for performing conversion between serial data and parallel data.

In this example, the sound signals of a plurality of channels are input and output as serial data through the first input/output terminal 33A and the second input/output terminal 34A. The DSP 22A outputs the sound signal of the first channel to the physical circuit 501A as parallel data.

The physical circuit 501A outputs the parallel data of the first channel output from the DSP 22A to the first conversion section 502A. Furthermore, the physical circuit 501A outputs the parallel data (corresponding to the output signal of the DSP 22B) of the second channel output from the second conversion section 503A, the parallel data (corresponding to the output signal of the DSP 22C) of the third channel, the parallel data (corresponding to the output signal of the DSP 22D) of the fourth channel and the parallel data (corresponding to the output signal of the DSP 22E) of the fifth channel to the first conversion section 502A.

Figure 8A:
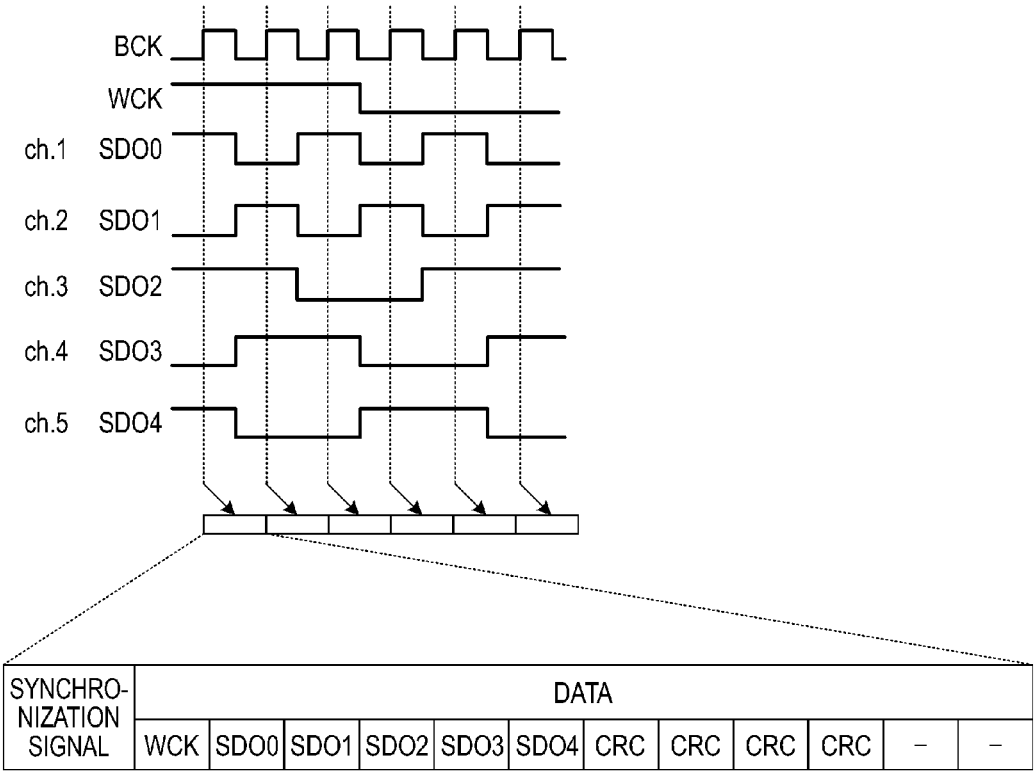
FIG. 8A is a conceptual diagram showing the conversion between serial data and parallel data.

FIG. 8A is a conceptual diagram showing the conversion between serial data and parallel data. The parallel data is composed of a bit clock (BCK) for synchronization, a word clock (WCK) and the signals SDO0 to SDO4 of the respective channels (five channels) as shown in the upper portion of FIG. 8A.

The serial data is composed of a synchronization signal and a data portion. The data portion contains the word clock, the signals SDO0 to SDO4 of the respective channels (five channels) and error correction codes CRC.

Such parallel data as shown in the upper portion of FIG. 8A is input from the physical circuit 501A to the first conversion section 502A. The first conversion section 502A converts the parallel data into such serial data as shown in the lower portion of FIG. 8A. The serial data is output to the first input/output terminal 33A and input to the host device 1. The host device 1 processes the sound signals of the respective channels on the basis of the input serial data.

On the other hand, such serial data as shown in the lower portion of FIG. 8A is input from the first conversion section 502B of the microphone unit 2B to the second conversion section 503A. The second conversion section 503A converts the serial data into such parallel data as shown in the upper portion of FIG. 8A and outputs the parallel data to the physical circuit 501A.

Figure 8B:
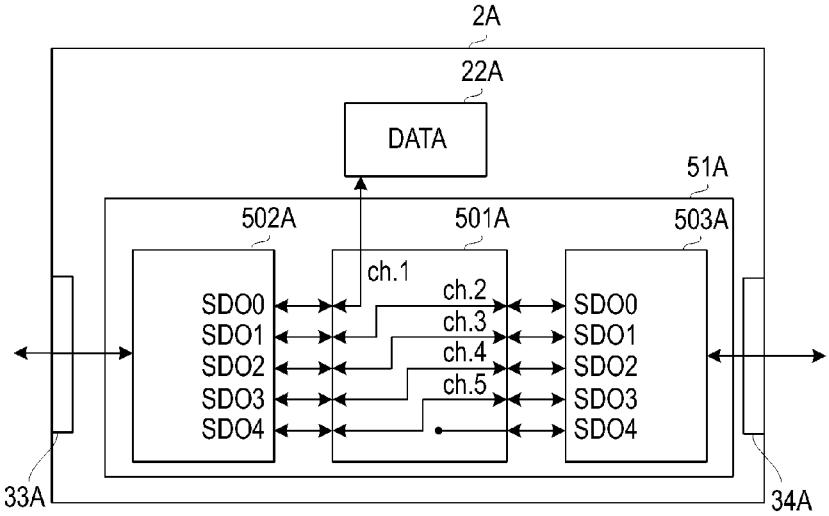
FIG. 8B is a view showing the flow of signals of the microphone unit.

Furthermore, as shown in FIG. 8B, by the physical circuit 501A, the signal SDO0 output from the second conversion section 503A is output as the signal SDO1 to the first conversion section 502A, the signal SDO1 output from the second conversion section 503A is output as the signal SDO2 to the first conversion section 502A, the signal SDO2 output from the second conversion section 503A is output as the signal SDO3 to the first conversion section 502A, and the signal SDO3 output from the second conversion section 503A is output as the signal SDO4 to the first conversion section 502A.

Hence, as in the case of the example shown in FIG. 6A, the sound signal (ch.1) of the first channel output from the DSP 22A is input as the sound signal of the first channel to the host device 1, the sound signal (ch.2) of the second channel output from the DSP 22B is input as the sound signal of the second channel to the host device 1, the sound signal (ch.3) of the third channel output from the DSP 22C is input as the sound signal of the third channel to the host device 1, the sound signal (ch.4) of the fourth channel output from the DSP 22D is input as the sound signal of the fourth channel to the host device 1, and the sound signal (ch.5) of the fifth channel output from the DSP 22E of the microphone unit 2E is input as the sound signal of the fifth channel to the host device 1.

Figure 9:
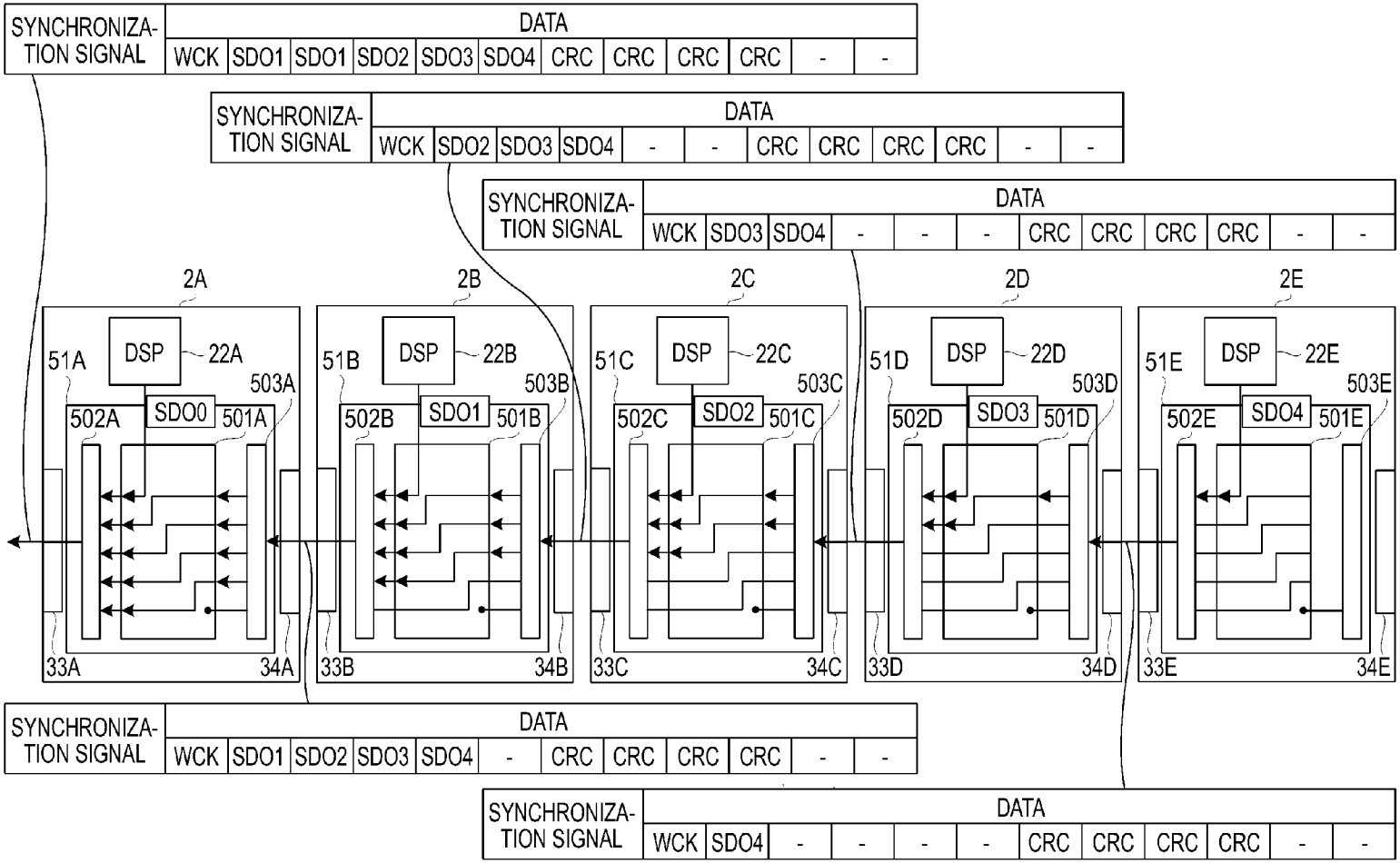
FIG. 9 is a view showing the flow of signals in the case that signals are transmitted from the respective microphone units to the host device.

The flow of the above-mentioned signals will be described below referring to FIG. 9. First, the DSP 22E of the microphone unit 2E processes the sound picked up by the microphone 25E thereof using the sound signal processing section 24A, and outputs a signal (signal SDO4) that was obtained by dividing the processed sound into unit bit data to the physical circuit 501E. The physical circuit 501E outputs the signal SDO4 as the parallel data of the first channel to the first conversion section 502E. The first conversion section 502E converts the parallel data into serial data. As shown in the lowermost portion of FIG. 9, the serial data contains data starting in order from the word clock, the leading unit bit data (the signal SDO4 in the figure), bit data 0 (indicated by hyphen "-" in the figure) and error correction codes CRC. This kind of serial data is output from the first input/output terminal 33E and input to the microphone unit 2D.

The second conversion section 503D of the microphone unit 2D converts the input serial data into parallel data and outputs the parallel data to the physical circuit 501D. Then, to the first conversion section 502D, the physical circuit 501D outputs the signal SDO4 contained in the parallel data as the second channel signal and also outputs the signal SDO3 input from the DSP 22D as the first channel signal. As shown in the third column in FIG. 9 from above, the first conversion section 502D converts the parallel data into serial data in which the signal SDO3 is inserted as the leading unit bit data following the word clock and the signal SDO4 is used as the second unit bit data. Furthermore, the first conversion section 502D newly generates error correction codes for this case (in the case that the signal SDO3 is the leading data and the signal SDO4 is the second data), attaches the codes to the serial data, and outputs the serial data.

This kind of serial data is output from the first input/output terminal 33D and input to the microphone unit 2C. A process similar to that described above is also performed in the microphone unit 2C. As a result, the microphone unit 2C outputs serial data in which the signal SDO2 is inserted as the leading unit bit data following the word clock, the signal SDO3 serves as the second unit bit data, the signal SDO4 serves as the third unit bit data, and new error correction codes CRC are attached. The serial data is input to the microphone unit 2B. A process similar to that described above is also performed in the microphone unit 2B. As a result, the microphone unit 2B outputs serial data in which the signal SDO1 is inserted as the leading unit bit data following the word clock, the signal SDO2 serves as the second unit bit data, the signal SDO3 serves as the third unit bit data, the signal SDO4 serves as the fourth unit bit data, and new error correction codes CRC are attached. The serial data is input to the microphone unit 2A. A process similar to that described above is also performed in the microphone unit 2A. As a result, the microphone unit 2A outputs serial data in which the signal SDO0 is inserted as the leading unit bit data following the word clock, the signal SDO1 serves as the second unit bit data, the signal SDO2 serves as the third unit bit data, the signal SDO3 serves as the fourth unit bit data, the signal SDO4 serves as the fifth unit bit data, and new error correction codes CRC are attached. The serial data is input to the host device 1.

In this way, as in the case of the example shown in FIG. 6A, the sound signal (ch.1) of the first channel output from the DSP 22A is input as the sound signal of the first channel to the host device 1, the sound signal (ch.2) of the second channel output from the DSP 22B is input as the sound signal of the second channel to the host device 1, the sound signal (ch.3) of the third channel output from the DSP 22C is input as the sound signal of the third channel to the host device 1, the sound signal (ch.4) of the fourth channel output from the DSP 22D is input as the sound signal of the fourth channel to the host device 1, and the sound signal (ch.5) of the fifth channel output from the DSP 22E of the microphone unit 2E is input as the sound signal of the fifth channel to the host device 1. In other words, each microphone unit divides the sound signal processed by each DSP into constant unit bit data and transmits the data to the microphone unit connected as the higher order unit, whereby the respective microphone units cooperate to create serial data to be transmitted.

Figure 10:
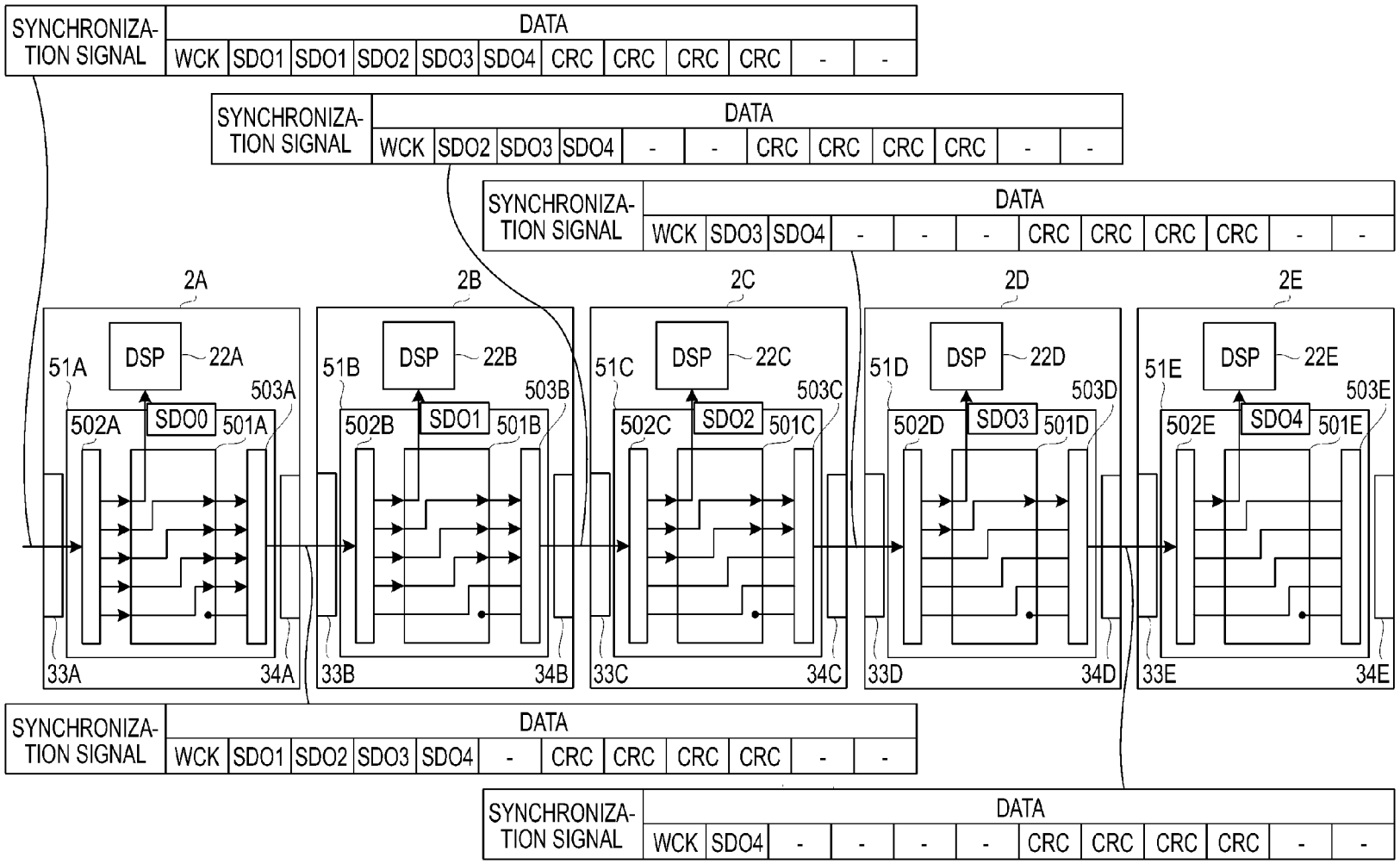
FIG. 10 is a view showing the flow of signals in the case that individual sound processing programs are transmitted from the host device to the respective microphone units.

Next, FIG. 10 is a view showing the flow of signals in the case that individual sound processing programs are transmitted from the host device 1 to the respective microphone units. In this case, a process in which the flow of the signals is opposite to that shown in FIG. 9 is performed.

First, the host device 1 creates serial data by dividing the sound signal processing program to be transmitted from the non-volatile memory 14 to each microphone unit into constant unit bit data, by reading and arranging the unit bit data in the order of being received by the respective microphone units. In the serial data, the signal SDO0 serves as the leading unit bit data following the word clock, the signal SDO1 serves as the second unit bit data, the signal SDO2 serves as the third unit bit data, the signal SDO3 serves as the fourth unit bit data, the signal SDO4 serves as the fifth unit bit data, and error correction codes CRC are attached. The serial data is first input to the microphone unit 2A. In the microphone unit 2A, the signal SDO0 serving as the leading unit bit data is extracted from the serial data, and the extracted unit bit data is input to the DSP 22A and temporarily stored in the volatile memory 23A.

Next, the microphone unit 2A outputs serial data in which the signal SDO1 serves as the leading unit bit data following the word clock, the signal SDO2 serves as the second unit bit data, the signal SDO3 serves as the third unit bit data, the signal SDO4 serves as the fourth unit bit data, and new error correction codes CRC are attached. The fifth unit bit data is 0 (hyphen "-" in the figure). The serial data is input to the microphone unit 2B. In the microphone unit 2B, the signal SDO1 serving as the leading unit bit data is input to the DSP 22B. Then, the microphone unit 2B outputs serial data in which the signal SDO2 serves as the leading unit bit data following the word clock, the signal SDO3 serves as the second unit bit data, the signal SDO4 serves as the third unit bit data, and new error correction codes CRC are attached. The serial data is input to the microphone unit 2C. In the microphone unit 2C, the signal SDO2 serving as the leading unit bit data is input to the DSP 22C. Then, the microphone unit 2C outputs serial data in which the signal SDO3 serves as the leading unit bit data following the word clock, the signal SDO4 serves as the second unit bit data, and new error correction codes CRC are attached. The serial data is input to the microphone unit 2D. In the microphone unit 2D, the signal SDO3 serving as the leading unit bit data is input to the DSP 22D. Then, the microphone unit 2D outputs serial data in which the signal SDO4 serves as the leading unit bit data following the word clock, and new error correction codes CRC are attached. In the end, the serial data is input to the microphone unit 2E, and the signal SDO4 serving as the leading unit bit data is input to the DSP 22E.

In this way, the leading unit bit data (signal SDO0) is surely transmitted to the microphone unit connected to the host device 1, the second unit bit data (signal SDO1) is surely transmitted to the second connected microphone unit, the third unit bit data (signal SDO2) is surely transmitted to the third connected microphone unit, the fourth unit bit data (signal SDO3) is surely transmitted to the fourth connected microphone unit, and the fifth unit bit data (signal SDO4) is surely transmitted to the fifth connected microphone unit.

Next, each microphone unit performs a process corresponding to the sound signal processing program obtained by combining the unit bit data. Also in this case, the microphone units being connected in series via the cables can be connected and disconnected as desired, and it is not necessary to give any consideration to the order of the connection. For example, in the case that the echo canceller program is transmitted to the microphone unit 2A closest to the host device 1 and that the noise canceller program is transmitted to the microphone unit 2E farthest from the host device 1, if the connection positions of the microphone unit 2A and the microphone unit 2E are exchanged, the echo canceller program is transmitted to the microphone unit 2E, and the noise canceller program is transmitted to the microphone unit 2A. Even if the order of the connection is exchanged as described above, the echo canceller program is executed in the microphone unit closest to the host device 1, and the noise canceller program is executed in the microphone unit farthest from the host device 1.

Figure 11:
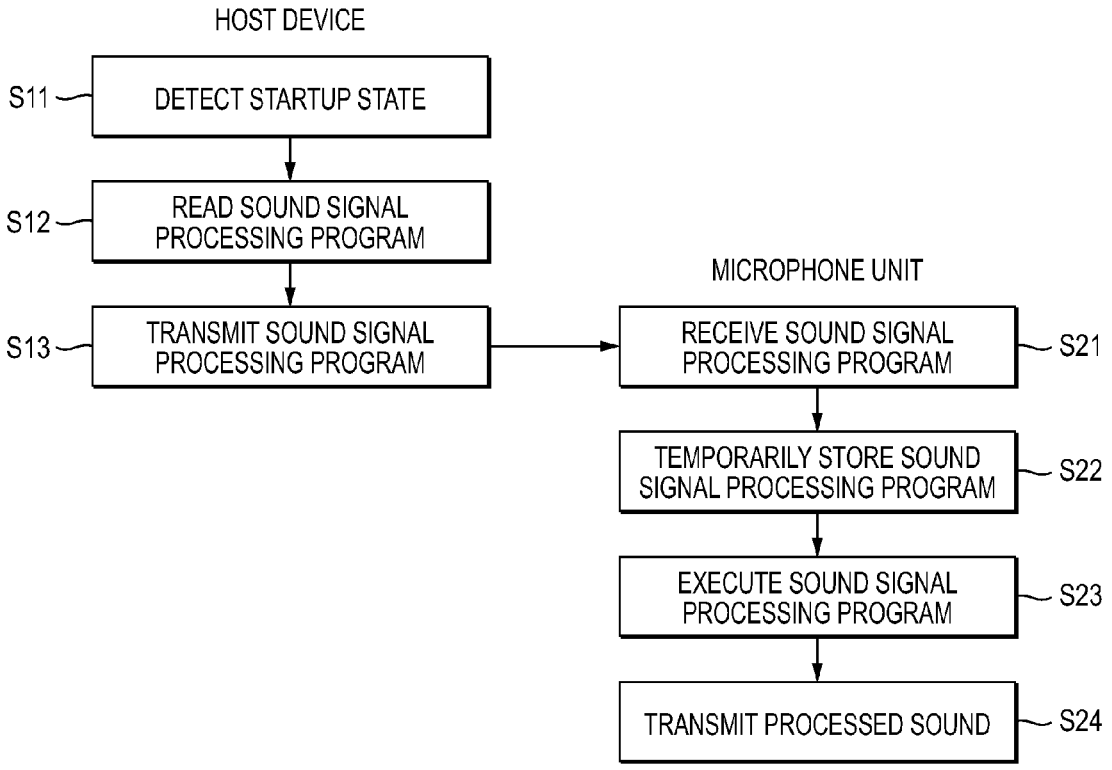
FIG. 11 is a flowchart showing the operation of the signal processing system.

Next, the operations of the host device 1 and the respective microphone units at the time of startup will be described referring to the flowchart shown in FIG. 11. When a microphone unit is connected to the host device 1 and when the CPU 12 of the host device 1 detects the startup state of the microphone unit (at S11), the CPU 12 reads a predetermined sound signal processing program from the non-volatile memory 14 (at S12), and transmits the program to the respective microphone units via the communication I/F 11 (at S13). At this time, the CPU 12 of the host device 1 creates serial data by dividing the sound processing program into constant unit bit data and by arranging the unit bit data in the order of being received by the respective microphone units as described above, and transmits the serial data to the microphone units.

Each microphone unit receives the sound signal processing program transmitted from the host device 1 (at S21) and temporarily stores the program (at S22). At this time, each microphone unit extracts the unit bit data to be received by the microphone unit from the serial data and receives and temporarily store the extracted unit bit data. Each microphone unit combines the temporarily stored unit bit data and performs a process corresponding to the combined sound signal processing program (at S23). Then, each microphone unit transmits a digital sound signal relating to the picked up sound (at S24). At this time, the digital sound signal processed by the sound signal processing section of each microphone unit is divided into constant unit bit data and transmitted to the microphone unit connected as the higher order unit, and the respective microphone units cooperate to create serial data to be transmitted and then transmit the serial data to be transmitted to the host device.

Although conversion into the serial data is performed in minimum bit unit in this example, the conversion is not limited to conversion in minimum bit unit, but conversion for each word may also be performed, for example.

Furthermore, if an unconnected microphone unit exists, even in the case that a channel with no signal exists (in the case that bit data is 0), the bit data of the channel is not deleted but contained in the serial data and transmitted. For example, in the case that the number of the microphone units is four, the bit data of the signal SDO4 surely becomes 0, but the signal SDO4 is not deleted but transmitted as a signal with bit data 0. Hence, it is not necessary to give any consideration to the relation of the connection as to whether which unit should correspond to which channel. In addition, address information, for example, as to whether which data should be transmitted to or received from which unit, is not necessary. Even if the order of the connection is exchanged, appropriate channel signals are output from the respective microphone units.

With this configuration in which serial data is transmitted among the units, the signal lines among the units do not increase even if the number of channels increases. Although a detector for detecting the startup states of the microphone units can detect the startup states by detecting the connection of the cables, the detector may detect the microphone units connected at the time of power-on. Furthermore, in the case that a new microphone unit is added during use, the detector detects the connection of the cable thereof and can detect the startup state thereof. In this case, it is possible to erase the programs of the connected microphone units and to transmit the sound signal processing program again from the host device to all the microphone units.

Figure 12:
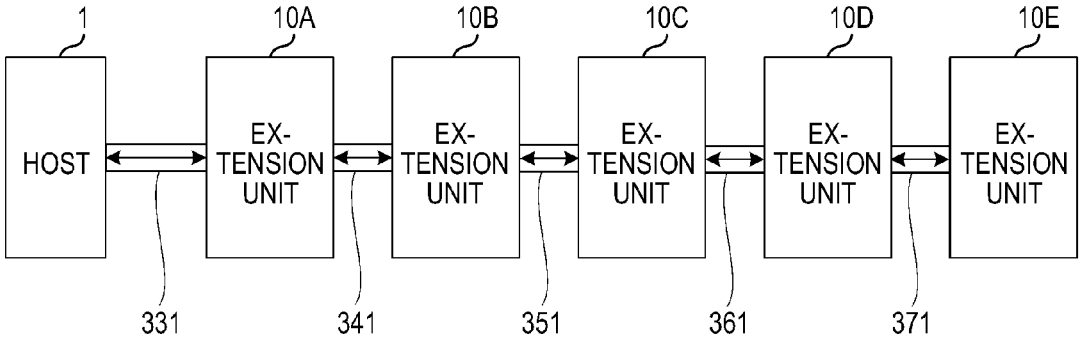
FIG. 12 is a block diagram showing the configuration of a signal processing system according to an application example.
Figure 13:
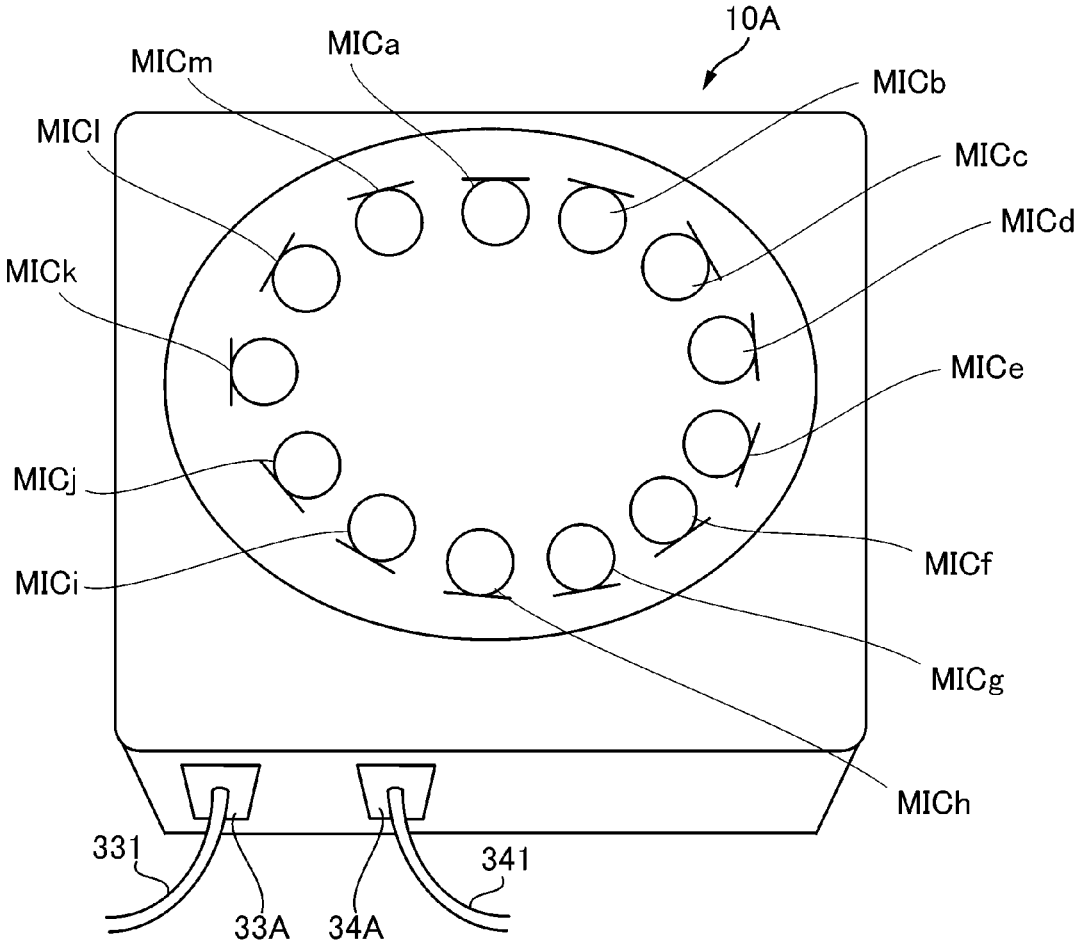
FIG. 13 is an external perspective view showing an extension unit according to the application example.
Figure 14:
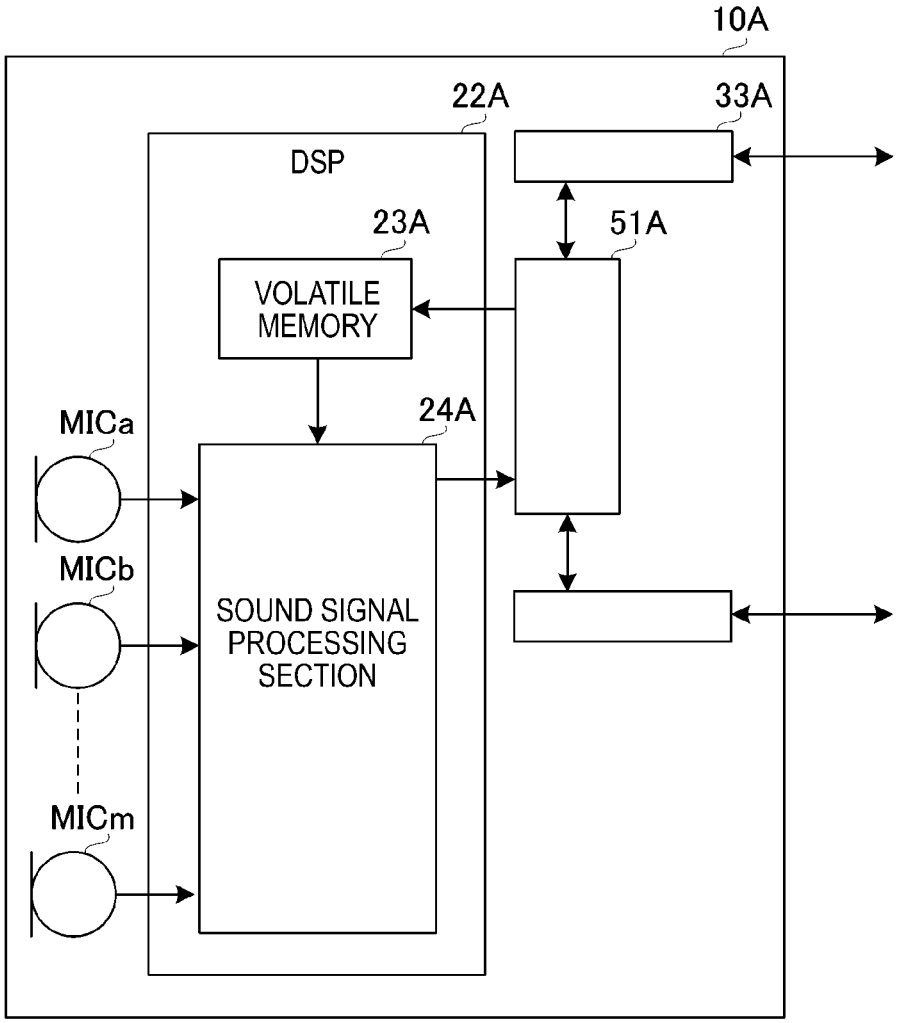
FIG. 14 is a block diagram showing the configuration of the extension unit according to the application example.

FIG. 12 is a view showing the configuration of a signal processing system according to an application example. The signal processing system according to the application example has extension units 10A to 10E connected in series and the host device 1 connected to the extension unit 10A. FIG. 13 is an external perspective view showing the extension unit 10A. FIG. 14 is a block diagram showing the configuration of the extension unit 10A. In this application example, the host device 1 is connected to the extension unit 10A via the cable 331. The extension unit 10A is connected to the extension unit 10B via the cable 341. The extension unit 10B is connected to the extension unit 10C via the cable 351. The extension unit 10C is connected to the extension unit 10D via the cable 361. The extension unit 10D is connected to the extension unit 10E via the cable 371. The extension units 10A to 10E have the same configuration. Hence, in the following description of the configuration of the extension units, the extension unit 10A is taken as a representative and described. The hardware configurations of all the extension units are the same.

Figure 15:
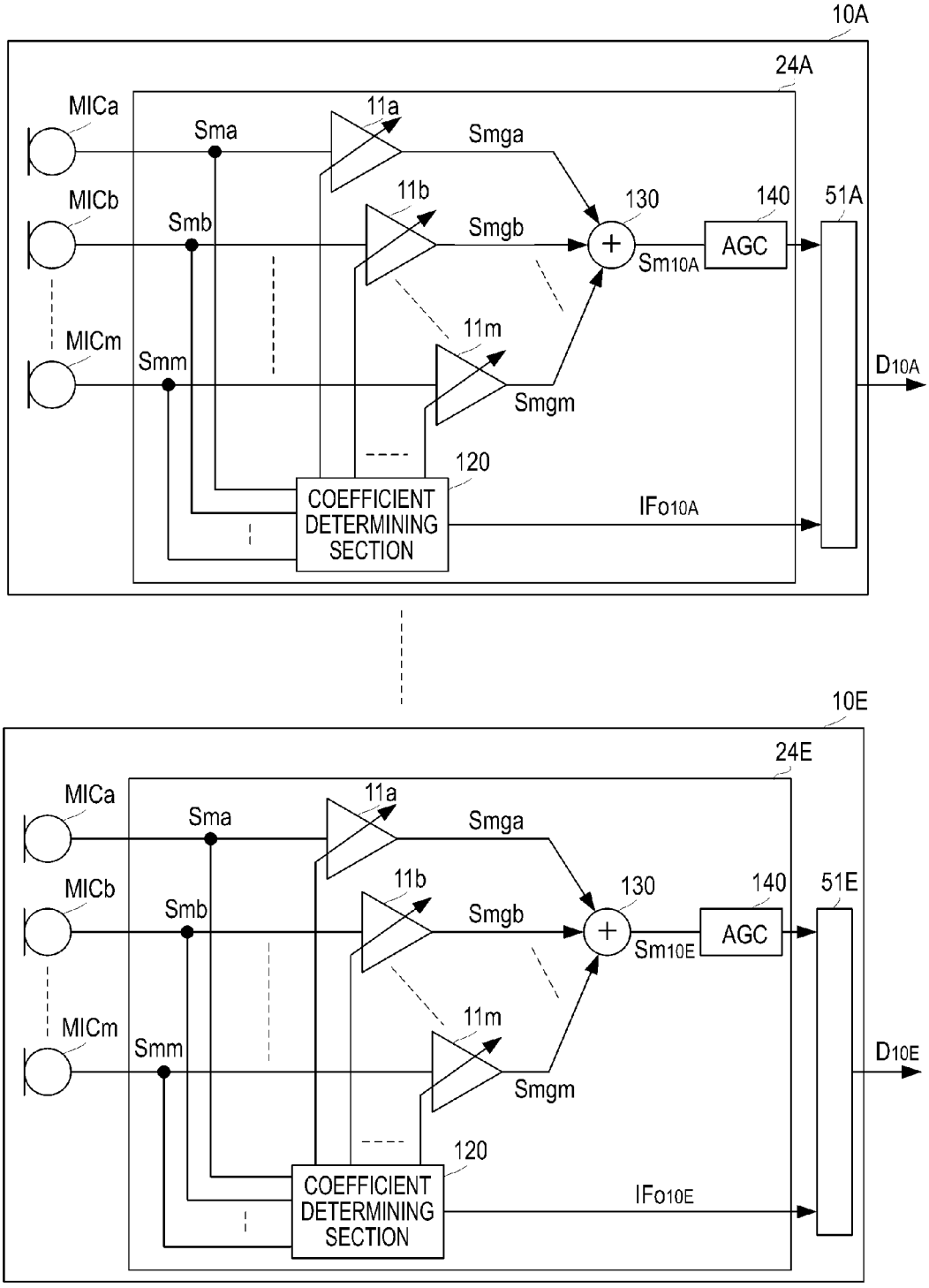
FIG. 15 is a block diagram showing the configuration of a sound signal processing section.

The extension unit 10A has the same configuration and function as those of the above-mentioned microphone unit 2A. However, the extension unit 10A has a plurality of microphones MICa to MICm instead of the microphone 25A. In addition, in this example, as shown in FIG. 15, the sound signal processing section 24A of the DSP 22A has amplifiers 11*a* to 11*m*, a coefficient determining section 120, a synthesizing section 130 and an AGC 140.

The number of the microphones to be required may be two or more and can be set appropriately depending on the sound pick-up specifications of a single extension unit. Accordingly, the number of the amplifiers may merely be the same as the number of the microphones. For example, if sound is picked up using a small number of microphones in the circumferential direction, only three microphones are sufficient.

The microphones MICa to MICm have different sound pick-up directions. In other words, the microphones MICa to MICm have predetermined sound pick-up directivities, and sound is picked up by using a specific direction as the main sound pick-up direction, whereby sound pick-up signals Sma to Smm are generated. More specifically, for example, the microphone MICa picks up sound by using a first specific direction as the main sound pick-up direction, thereby generating a sound pick-up signal Sma. Similarly, the microphone MICb picks up sound by using a second specific direction as the main sound pick-up direction, thereby generating a sound pick-up signal Smb.

The microphones MICa to MICm are installed in the extension unit 10A so as to be different in sound pick-up directivity. In other words, the microphones MICa to MICm are installed in the extension unit 10A so as to be different in the main sound pick-up direction.

The sound pick-up signals Sma to Smm output from the microphones MICa to MICm are input to the amplifiers 11*a* to 11*m*, respectively. For example, the sound pick-up signal Sma output from the microphone MICa is input to the amplifier 11*a*, and the sound pick-up signal Smb output from the microphone MICb is input to the amplifier 11*b*. The sound pick-up signal Smm output from the microphone MICm is input to the amplifier 11*m*. Furthermore, the sound pick-up signals Sma to Smm are input to the coefficient determining section 120. At this time, the sound pick-up signals Sma to Smm, analog signals, are converted into digital signals and then input to the amplifiers 11*a* to 11*m*.

The coefficient determining section 120 detects the signal powers of the sound pick-up signals Sma to Smm, compares the signal powers of the sound pick-up signals Sma to Smm, and detects the sound pick-up signal having the highest power. The coefficient determining section 120 sets the gain coefficient for the sound pick-up signal detected to have the highest power to "1." The coefficient determining section 120 sets the gain coefficients for the sound pick-up signals other than the sound pick-up signal detected to have the highest power to "0."

The coefficient determining section 120 outputs the determined gain coefficients to the amplifiers 11*a* to 11*m*. More specifically, the coefficient determining section 120 outputs gain coefficient "1" to the amplifier to which the sound pick-up signal detected to have the highest power is input and outputs gain coefficient "0" to the other amplifiers.

The coefficient determining section 120 detects the signal level of the sound pick-up signal detected to have the highest power and generates level information IFo10A. The coefficient determining section 120 outputs the level information IFo10A to the FPGA 51A.

The amplifiers 11*a* to 11*m* are amplifiers, the gains of which can be adjusted. The amplifiers 11*a* to 11*m* amplify the sound pick-up signals Sma to Smm with the gain coefficients given by the coefficient determining section 120 and generate post-amplification sound pick-up signals Smga to Smgm, respectively. More specifically, for example, the amplifier 11*a* amplifies the sound pick-up signal Sma with the gain coefficient from the coefficient determining section 120 and outputs the post-amplification sound pick-up signal Smga. The amplifier 11*b* amplifies the sound pick-up signal Smb with the gain coefficient from the coefficient determining section 120 and outputs the post-amplification sound pick-up signal Smgb. The amplifier 11*m* amplifies the sound pick-up signal Smm with the gain coefficient from the coefficient determining section 120 and outputs the post-amplification sound pick-up signal Smgm.

Since the gain coefficient is herein "1" or "0" as described above, the amplifier to which the gain coefficient "1" was given outputs the sound pick-up signal while the signal level thereof is maintained. In this case, the post-amplification sound pick-up signal is the same as the sound pick-up signal.

On the other hand, the amplifiers to which the gain coefficient "0" was given suppress the signal levels of the sound pick-up signals to "0." In this case, the post-amplification sound pick-up signals have signal level "0."

The post-amplification sound pick-up signals Smga to Smgm are input to the synthesizing section 130. The synthesizing section 130 is an adder and adds the post-amplification sound pick-up signals Smga to Smgm, thereby generating an extension unit sound signal Sm10A.

Among the post-amplification sound pick-up signals Smga to Smgm, only the post-amplification sound pick-up signal corresponding to the sound pick-up signal having the highest power among the sound pick-up signals Sma to Smm serving as the origins of the post-amplification sound pick-up signals Smga to Smgm has the signal level corresponding to the sound pick-up signal, and the others have signal level "0."

Hence, the extension unit sound signal Sm10A obtained by adding the post-amplification sound pick-up signals Smga to Smgm is the same as the sound pick-up signal detected to have the highest power.

With the above-mentioned process, the sound pick-up signal having the highest power can be detected and output as the extension unit sound signal Sm10A. This process is executed sequentially at predetermined time intervals. Hence, if the sound pick-up signal having the highest power changes, in other words, if the sound source of the sound pick-up signal having the highest power moves, the sound pick-up signal serving as the extension unit sound signal Sm10A is changed depending on the change and movement. As a result, it is possible to track the sound source on the basis of the sound pick-up signal of each microphone and to output the extension unit sound signal Sm10A in which the sound from the sound source has been picked up most efficiently.

The AGC 140, the so-called auto-gain control amplifier, amplifies the extension unit sound signal Sm10A with a predetermined gain and outputs the amplified signal to the FPGA 51A. The gain to be set in the AGC 140 is appropriately set according to communication specifications. More specifically, for example, the gain to be set in the AGC 140 is set by estimating transmission loss in advance and by compensating the transmission loss.

By performing this gain control of the extension unit sound signal Sm10A, the extension unit sound signal Sm10A can be transmitted accurately and securely from the extension unit 10A to the host device 1. As a result, the host device 1 can receive the extension unit sound signal Sm10A accurately and securely and can demodulate the signal.

Next, the extension unit sound signal Sm10A processed by the AGC and the level information IFo10A are input to the FPGA 51A.

The FPGA 51A generates extension unit data D10A on the basis of the extension unit sound signal Sm10A processed by the AGC and the level information IFo10A and transmits the signal and the information to the host device 1. At this time, the level information IFo10A is data synchronized with the extension unit sound signal Sm10A allocated to the same extension unit data.

FIG. 16 is a view showing an example of the data format of the extension unit data to be transmitted from each extension unit to the host device. The extension unit data D10A is composed of a header DH by which the extension unit serving as a sender can be identified, the extension unit sound signal Sm10A and the level information IFo10A, a predetermined number of bits being allocated to each of them. For example, as shown in FIG. 16, after the header DH, the extension unit sound signal Sm10A having a predetermined number of bits is allocated, and after the bit string of the extension unit sound signal Sm10A, the level information IFo10A having a predetermined number of bits is allocated.

As in the case of the above-mentioned extension unit 10A, the other extension units 10B to 10E respectively generate extension unit data D10B to 10E containing extension unit sound signals Sm10B to Sm10E and level information IFo10B to IFo10E and then outputs the data. Each of the extension unit data D10B to 10E is divided into constant unit bit data and transmitted to the microphone unit connected as the higher order unit, and the respective microphone units cooperate to create serial data.

Figure 17:
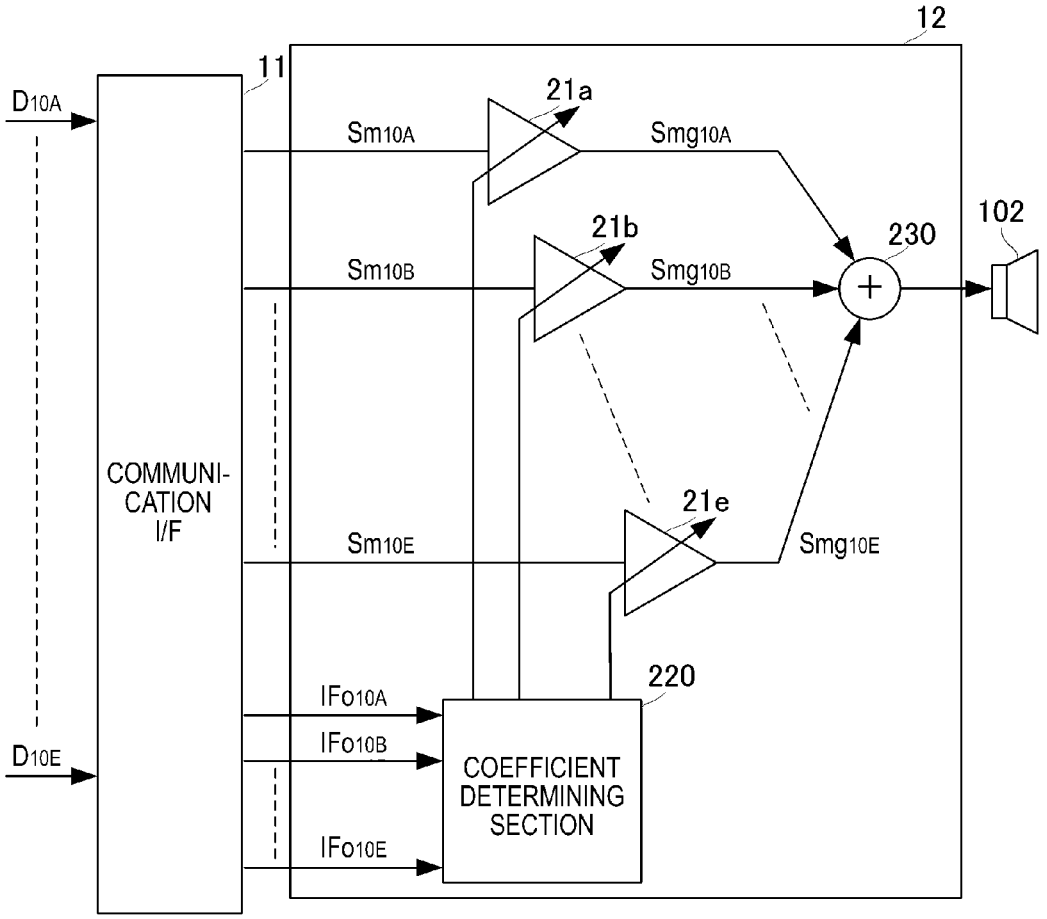
FIG. 17 is a block diagram showing the configuration of the host device according to the application example.

FIG. 17 is a block diagram showing various configurations implemented at the time when the CPU 12 of the host device 1 executes a predetermined sound signal processing program.

The CPU 12 of the host device 1 has a plurality of amplifiers 21*a* to 21*e*, a coefficient determining section 220 and a synthesizing section 230.

The extension unit data D10A to D10E from the extension units 10A to 10E are input to the communication I/F 11. The communication I/F 11 demodulates the extension unit data D10A to D10E and obtains the extension unit sound signals Sm10A to Sm10E and the level information IFo10A to IFo10E.

The communication I/F 11 outputs the extension unit sound signals Sm10A to Sm10E to the amplifiers 21*a* to 21*e*, respectively. More specifically, the communication I/F 11 outputs the extension unit sound signal Sm10A to the amplifier 21*a* and outputs the extension unit sound signal Sm10B to the amplifier 21*b*. Similarly, the communication I/F 11 outputs the extension unit sound signal Sm10E to the amplifier 21*e*.

The communication I/F 11 outputs the level information IFo10A to IFo10E to the coefficient determining section 220.

The coefficient determining section 220 compares the level information IFo10A to IFo10E and detects the highest level information.

The coefficient determining section 220 sets the gain coefficient for the extension unit sound signal corresponding to the level information detected to have the highest level to "1." The coefficient determining section 220 sets the gain coefficients for the sound pick-up signals other than the extension unit sound signal corresponding to the level information detected to have the highest level to "0."

The coefficient determining section 220 outputs the determined gain coefficients to the amplifiers 21*a* to 21*e*. More specifically, the coefficient determining section 220 outputs gain coefficient "1" to the amplifier to which the extension unit sound signal corresponding to the level information detected to have the highest level is input and outputs gain coefficient "0" to the other amplifiers.

The amplifiers 21*a* to 21*e* are amplifiers, the gains of which can be adjusted. The amplifiers 21*a* to 21*e* amplify the extension unit sound signals Sm10A to Sm10E with the gain coefficients given by the coefficient determining section 220 and generate post-amplification sound signals Smg10A to Smg10E, respectively.

More specifically, for example, the amplifier 21*a* amplifies the extension unit sound signal Sm10A with the gain coefficient from the coefficient determining section 220 and outputs the post-amplification sound signal Smg10A. The amplifier 21*b* amplifies the extension unit sound signal Sm10B with the gain coefficient from the coefficient determining section 220 and outputs the post-amplification sound signal Smg10B. The amplifier 21*e* amplifies the extension unit sound signal Sm10E with the gain coefficient from the coefficient determining section 220 and outputs the post-amplification sound signal Smg10E.

Since the gain coefficient is herein "1" or "0" as described above, the amplifier to which the gain coefficient "1" was given outputs the extension unit sound signal while the signal level thereof is maintained. In this case, the post-amplification sound signal is the same as the extension unit sound signal.

On the other hand, the amplifiers to which the gain coefficient "0" was given suppress the signal levels of the extension unit sound signals to "0." In this case, the post-amplification sound signals have signal level "0."

The post-amplification sound signals Smg10A to Smg10E are input to the synthesizing section 230. The synthesizing section 230 is an adder and adds the post-amplification sound signals Smg10A to Smg10E, thereby generating a tracking sound signal.

Among the post-amplification sound signals Smg10A to Smg10E, only the post-amplification sound signal corresponding to the sound signal having the highest level among the extension unit sound signals Sm10A to Sm10E serving as the origins of the post-amplification sound signals Smg10A to Smg10E has the signal level corresponding to the extension unit sound signal, and the others have signal level "0."

Hence, the tracking sound signal obtained by adding the post-amplification sound signals Smg10A to Smg10E is the same as the extension unit sound signal detected to have the highest power level.

With the above-mentioned process, the extension unit sound signal having the highest level can be detected and output as the tracking sound signal. This process is executed sequentially at predetermined time intervals. Hence, if the extension unit sound signal having the highest level changes, in other words, if the sound source of the extension unit sound signal having the highest power moves, the extension unit sound signal serving as the tracking sound signal is changed depending on the change and movement. As a result, it is possible to track the sound source on the basis of the extension unit sound signal of each extension unit and to output the tracking sound signal in which the sound from the sound source has been picked up most efficiently.

With the above-mentioned configuration and process, first stage sound source tracing is performed using the sound pick-up signals in the microphones by the extension units 10A to 10E, and second stage sound source tracing is performed using the extension unit sound signals of the respective extension units 10A to 10E in the host device 1. As a result, sound source tracing using the plurality of microphones MICa to MICm of the plurality of extension units 10A to 10E can be achieved. Hence, by appropriate setting of the number and the arrangement pattern of the extension units 10A and 10E, sound source tracing can be performed securely without being affected by the size of the sound pick-up range and the position of the sound source, such as a speaker. Hence, the sound from the sound source can be picked up at high quality, regardless of the position of the sound source.

Furthermore, the number of the sound signals transmitted by each of the extension units 10A to 10E is one regardless of the number of the microphones installed in the extension unit. Hence, the amount of communication data can be reduced in comparison with a case in which the sound pick-up signals of all the microphones are transmitted to the host device. For example, in the case that the number of the microphones installed in each extension unit is m, the number of the sound data transmitted from each extension unit to the host device is 1/m in comparison with the case in which all the sound pick-up signals are transmitted to the host device.

With the above-mentioned configurations and processes according to this embodiment, the communication load of the system can be reduced while the same sound source tracing accuracy as in the case that all the sound pick-up signals are transmitted to the host device is maintained. As a result, more real-time sound source tracing can be performed.

Figure 18:
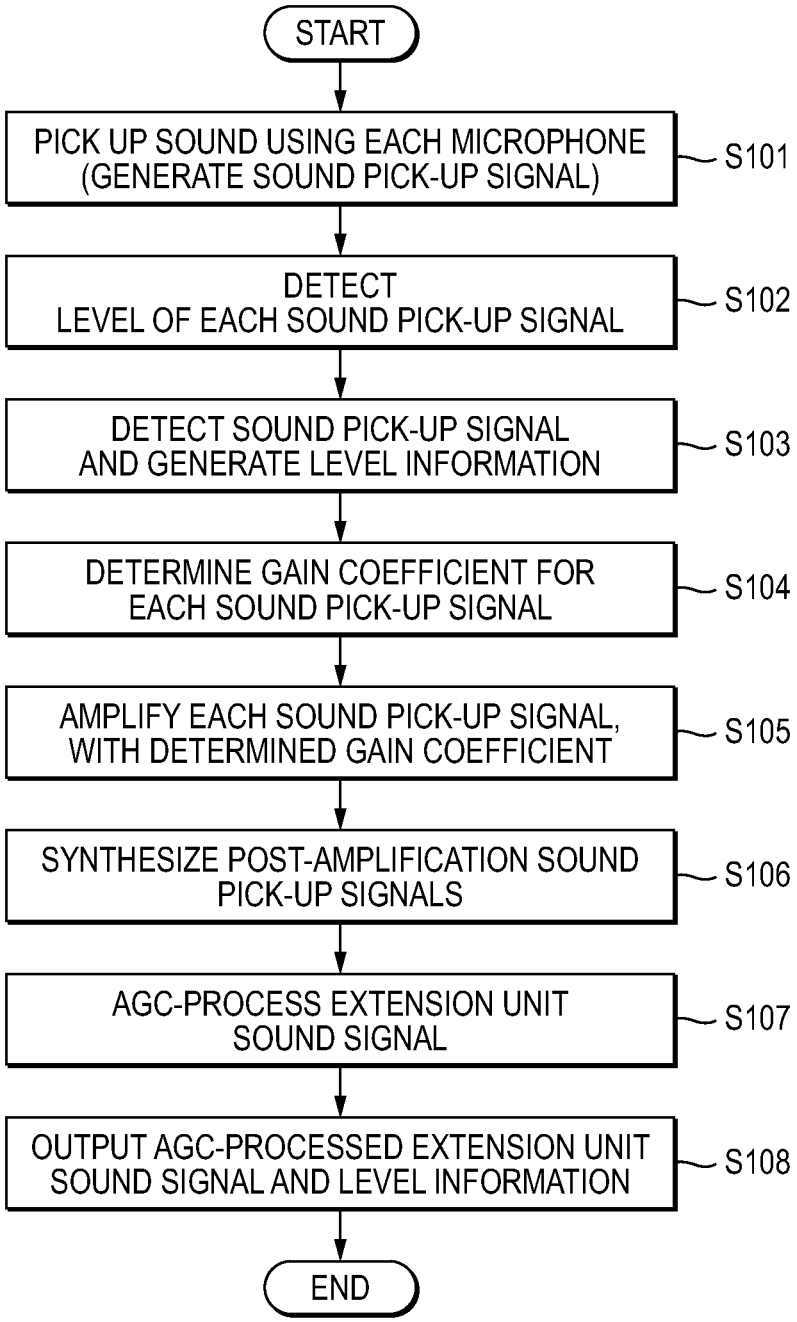
FIG. 18 is a flowchart for the sound source tracing process of the extension unit.

FIG. 18 is a flowchart for the sound source tracing process of the extension unit according to the embodiment of the present invention. Although the flow of the process performed by a single extension unit is described below, the plurality of extension units execute the same flow process. In addition, since the detailed contents of the process have been described above, detailed description is omitted in the following description.

The extension unit picks up sound using each microphone and generates a sound pick-up signal (at S101). The extension unit detects the level of the sound pick-up signal of each microphone (at S102). The extension unit detects the sound pick-up signal having the highest power and generates the level information of the sound pick-up signal having the highest power (at S103).

The extension unit determines the gain coefficient for each sound pick-up signal (at S104). More specifically, the extension unit sets the gain of the sound pick-up signal having the highest power to "1" and sets the gains of the other sound pick-up signals to "0."

The extension unit amplifies each sound pick-up signal with the determined gain coefficient (at S105). The extension unit synthesizes the post-amplification sound pick-up signals and generates an extension unit sound signal (at S106).

The extension unit AGC-processes the extension unit sound signal (at S107), generates extension unit data containing the AGC-processed extension unit sound signal and level information, and outputs the signal and information to the host device (at S108).

Figure 19:
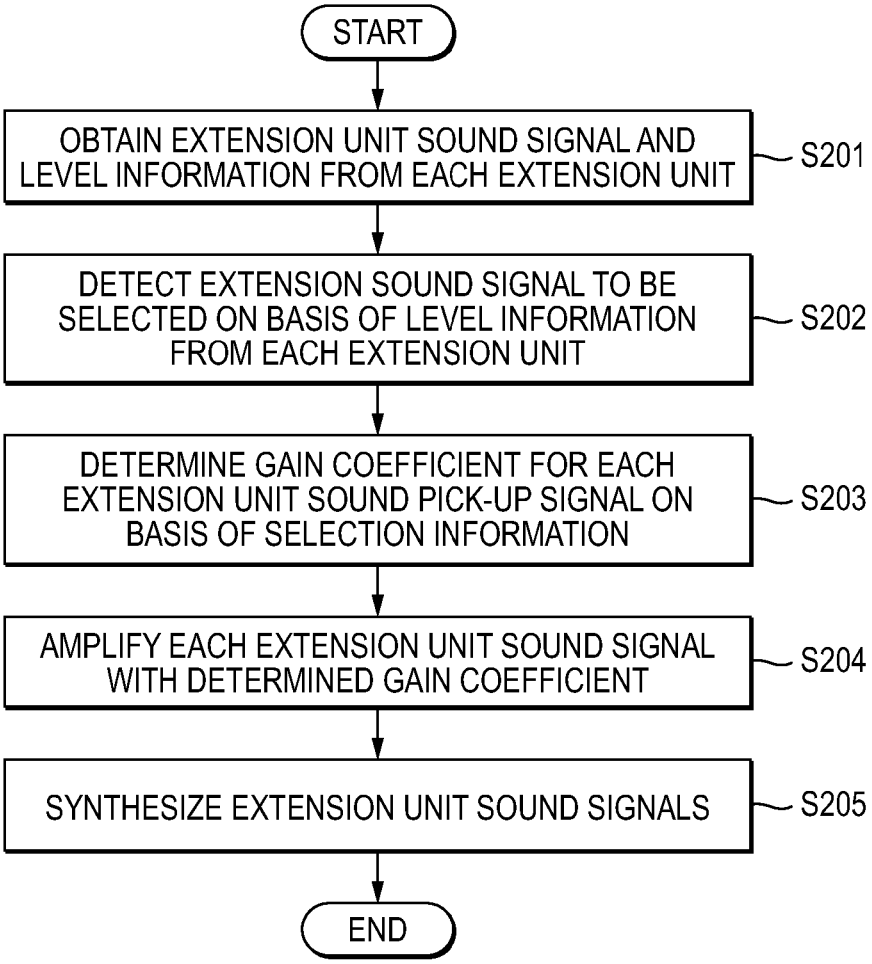
FIG. 19 is a flowchart for the sound source tracing process of the host device.

FIG. 19 is a flowchart for the sound source tracing process of the host device according to the embodiment of the present invention. Furthermore, since the detailed contents of the process have been described above, detailed description is omitted in the following description.

The host device 1 receives the extension unit data from each extension unit and obtains the extension unit sound signal and the level information (at S201). The host device 1 compares the level information from the respective extension units and detects the extension unit sound signal having the highest level (at S202).

The host device 1 determines the gain coefficient for each extension unit sound signal (at S203). More specifically, the host device 1 sets the gain of the extension unit sound signal having the highest level to "1" and sets the gains of the other extension unit sound signals to "0."

The host device 1 amplifies each extension unit sound signal with the determined gain coefficient (at S204). The host device 1 synthesizes the post-amplification extension unit sound signals and generates a tracking sound signal (at S205).

In the above-mentioned description, at the switching timing of the sound pick-up signal having the highest power, the gain coefficient of the previous sound pick-up signal having the highest power is set from "1" to "0" and the gain coefficient of the new sound pick-up signal having the highest power is switched from "0" to "1." However, these gain coefficients may be changed in a more detailed stepwise manner. For example, the gain coefficient of the previous sound pick-up signal having the highest power is gradually lowered from "1" to "0" and the gain coefficient of the new sound pick-up signal having the highest power is gradually increased from "0" to "1." In other words, a cross-fade process may be performed for the switching from the previous sound pick-up signal having the highest power to the new sound pick-up signal having the highest power. At this time, the sum of these gain coefficients is set to "1."

In addition, this kind of cross-fade process may be applied to not only the synthesis of the sound pick-up signals performed in each extension unit but also the synthesis of the extension unit sound signals performed in the host device 1.

Figure 20:
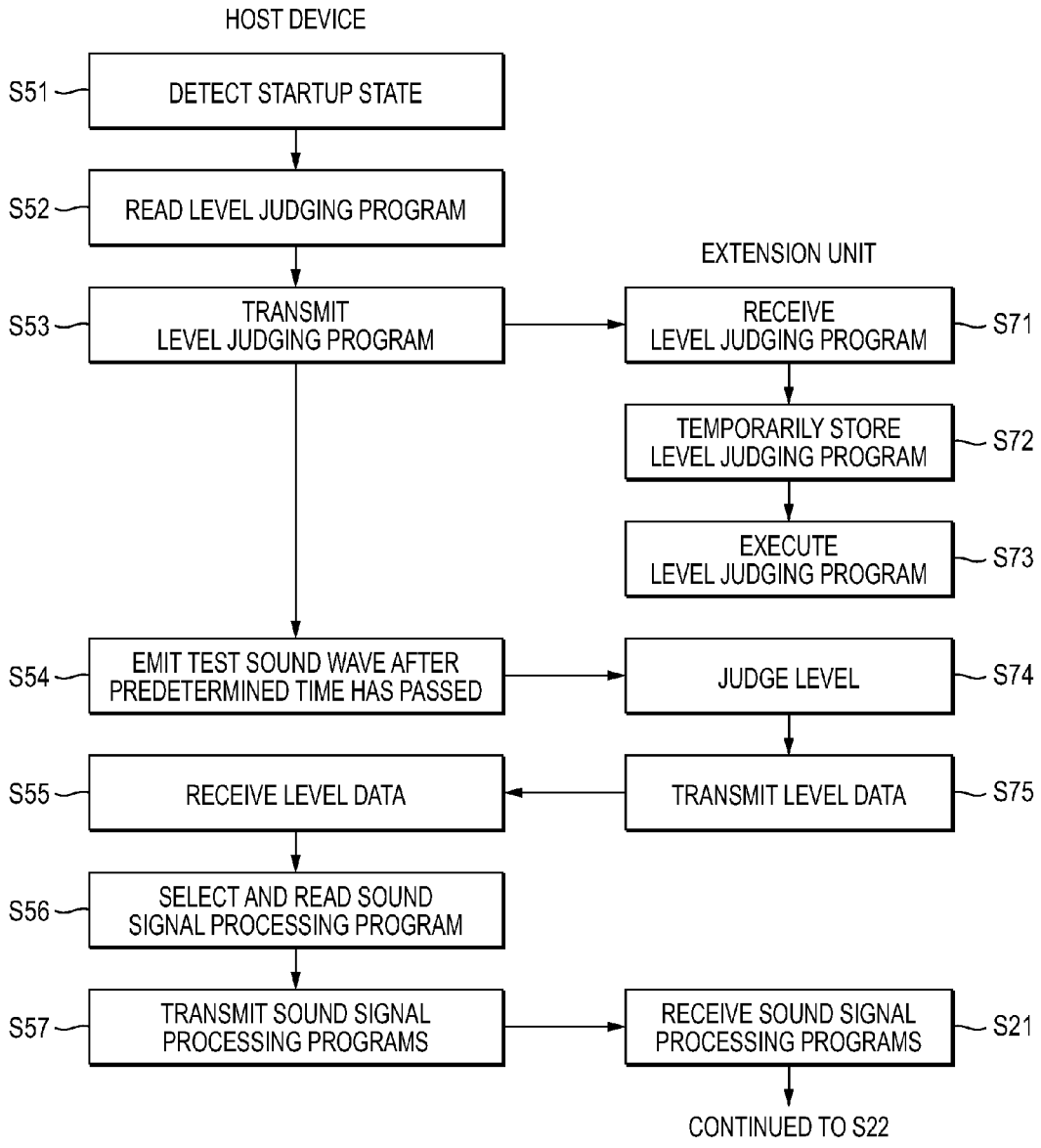
FIG. 20 is a flowchart showing operation in the case that a test sound wave is issued to make a level judgment.

Furthermore, in the above-mentioned description, although an example in which the AGC is provided for each of the extension units 10A to 10E, the AGC may be provided for the host device 1. In this case, the communication I/F 11 of the host device 1 may merely be used to perform the function of the AGC, As shown in the flowchart of FIG. 20, the host device 1 can emit a test sound wave toward each extension unit from the speaker 102 to allow each extension unit to judge the level of the test sound wave.

First, when the host device 1 detects the startup state of the extension units (at S51), the host device 1 reads a level judging program from the non-volatile memory 14 (at S52) and transmits the program to the respective extension units via the communication I/F 11 (at S53). At this time, the CPU 12 of the host device 1 creates serial data by dividing the level judging program into constant unit bit data and by arranging the unit bit data in the order of being received by the respective extension units, and transmits the serial data to the extension units.

Each extension unit receives the level judging program transmitted from the host device 1 (at S71). The level judging program is temporarily stored in the volatile memory 23A (at S72). At this time, each extension unit extracts the unit bit data to be received by the extension unit from the serial data and receives and temporarily stores the extracted unit bit data. Then, each extension unit combines the temporarily stored unit bit data and executes the combined level judging program (at S73). As a result, the sound signal processing section 24 achieves the configuration shown in FIG. 15. However, the level judging program is used to make only level judgment, but is not required to generate and transmit the extension unit sound signal Sm10A. Hence, the configuration composed of the amplifiers 11*a* to 11*m*, the coefficient determining section 120, the synthesizing section 130 and the AGC 140 is not necessary.

Next, the host device 1 emits the test sound wave after a predetermined time has passed from the transmission of the level judging program (at S54). The coefficient determining section 220 of each extension unit functions as a sound level detector and judges the level of the test sound wave input to each of the plurality of the microphones MICa to MICm (at S74). The coefficient determining section 220 transmits level information (level data) serving as the result of the judgment to the host device 1 (at S75). The level data of each of the plurality of microphones MICa to MICm may be transmitted or only the level data indicating the highest level in each extension unit may be transmitted. The level data is divided into constant unit bit data and transmitted to the extension unit connected at upstream side as the higher order unit, whereby the respective extension units cooperate to create serial data for level judgment.

Next, the host device 1 receives the level data from each extension unit (at S55). On the basis of the received level data, the host device 1 selects sound signal processing programs to be transmitted to the respective extension units and reads the programs from the non-volatile memory 14 (at S56). For example, the host device 1 judges that an extension unit with a high test sound wave level has a high echo level, thereby selecting the echo canceller program. Furthermore, the host device 1 judges that an extension unit with a low test sound wave level has a low echo level, thereby selecting the noise canceller program. Then, the host device 1 reads and transmits the sound signal processing programs to the respective extension units (S57). Since the subsequent process is the same as that shown in the flowchart of FIG. 11, the description thereof is omitted.

It may be possible that the host device 1 changes the number of the filter coefficients of each extension unit in the echo canceller program on the basis of the received level data and determines a change parameter for changing the number of the filter coefficients for each extension unit. For example, the number of taps is increased in an extension unit having a high test sound wave level, and the number of taps is decreased in an extension unit having a low test sound wave level. In this case, the host device 1 creates serial data by dividing the change parameter into constant unit bit data and by arranging the unit bit data in the order of being received by the respective extension units, and transmits the serial data to the respective extension units.

Furthermore, it may be possible to adopt a mode in which each of the plurality of microphones MICa to MICm of each extension unit has the echo canceller. In this case, the coefficient determining section 220 of each extension unit transmits the level data of each of the plurality of microphones MICa to MICm.

Moreover, the identification information of the microphones in each extension unit may be contained in the above-mentioned level information IFo10A to IFo10E.

Figure 21:
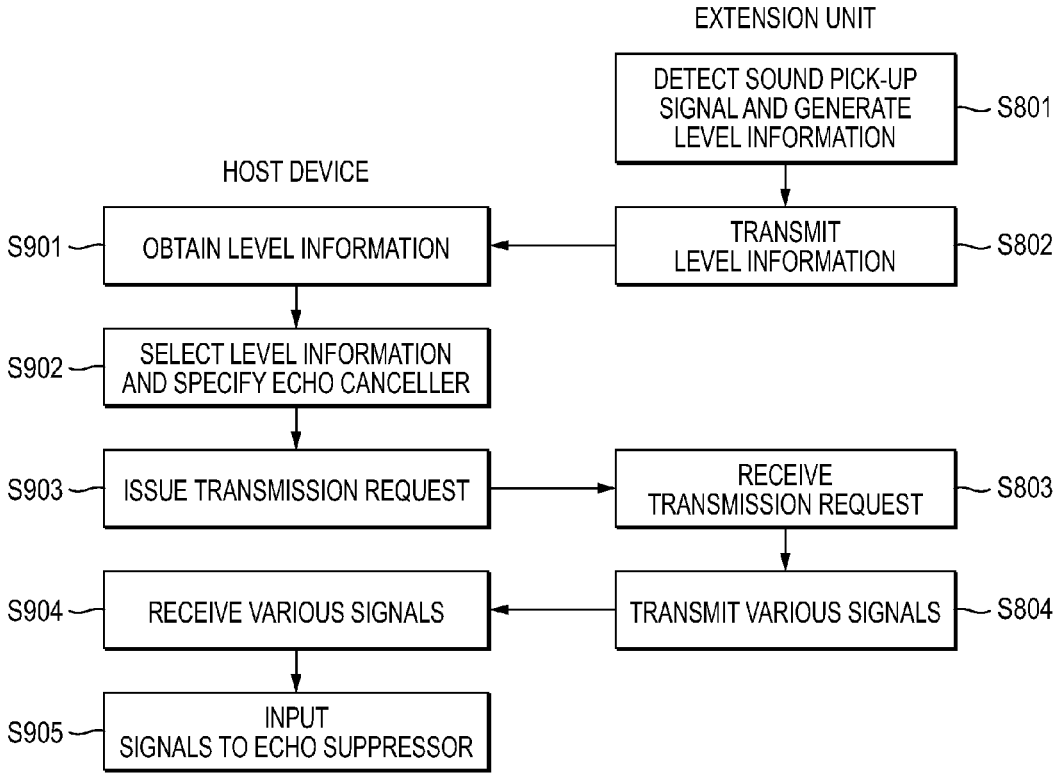
FIG. 21 is a flowchart showing operation in the case that the echo canceller of one of the extension units is specified.

In this case, as shown in FIG. 21, when an extension unit detects a sound pick-up signal having the highest power and generates the level information of the sound pick-up signal having the highest power (at S801), the extension unit transmits the level information containing the identification information of the microphone in which the highest power was detected (at S802).

Then, the host device 1 receives the level information from the respective extension unit (at S901). At the time of the selection of the level information having the highest level, on the basis of the identification information of the microphone contained in the selected level information, the microphone is specified, whereby the echo canceller being used is specified (at S902). The host device 1 requests the transmission of various signals regarding the echo canceller to the extension unit in which the specified echo canceller is used (at S903).

Next, upon receiving the transmission request (at S803), the extension unit transmits, to the host device 1, the various signals including the pseudo-regression sound signal from the designated echo canceller, the sound pick-up signal NE1 (the sound pick-up signal before the echo component is removed by the echo canceller at the previous stage) and the sound pick-up signal NE1' (the sound pick-up signal after the echo component was removed by the echo canceller at the previous stage) (at S804).

The host device 1 receives these various signals (at S904) and inputs the received various signals to the echo suppressor (at S905). As a result, a coefficient corresponding to the learning progress degree of the specific echo canceller is set in the echo generating section 125 of the echo suppressor, whereby an appropriate residual echo component can be generated.

Figure 22:
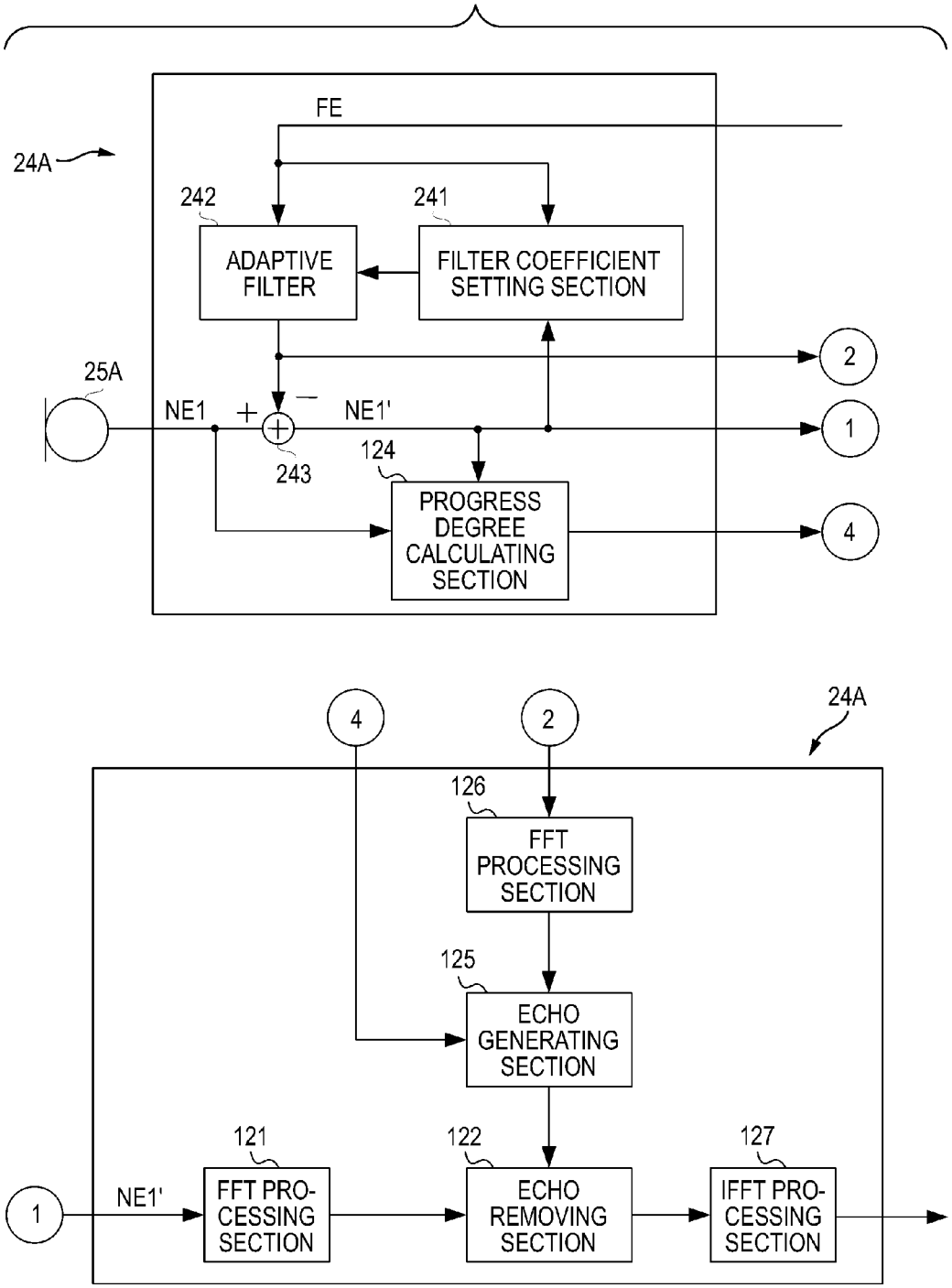
FIG. 22 is a block diagram in the case that an echo suppressor is configured in the host device.

As shown in FIG. 22, it may be possible to use a mode in which the progress degree calculating section 124 is provided on the side of the sound signal processing section 24A. In this case, at S903 of FIG. 21, the host device 1 requests the transmission of the coefficient changing depending on the learning progress degree to the extension unit in which the specified echo canceller is used. At S804, the extension unit reads the coefficient calculated by the progress degree calculating section 124 and transmits the coefficient to the host device 1. The echo generating section 125 generates a residual echo component depending on the received coefficient and the pseudo-regression sound signal.

Figure 23A:
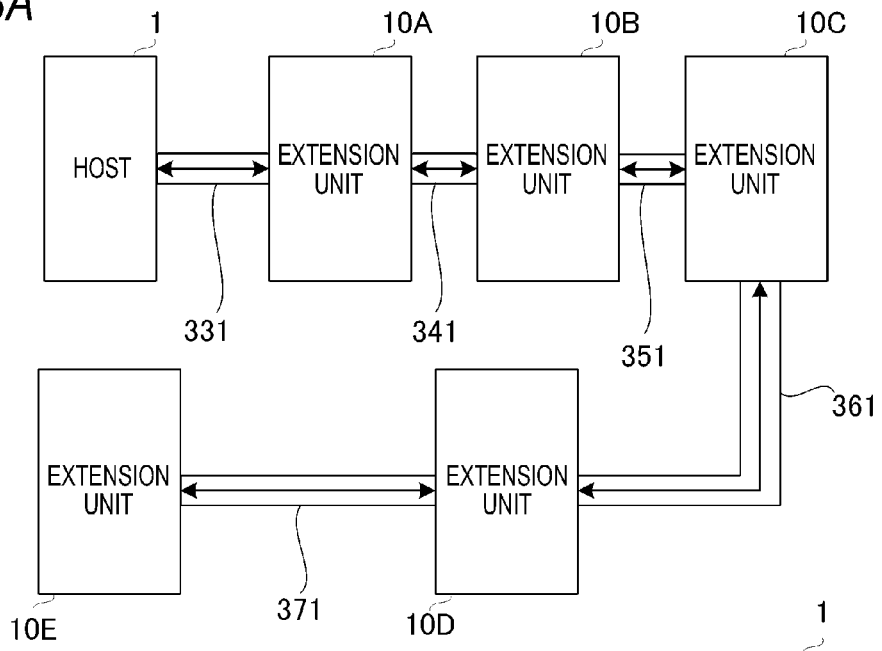
FIGS. 23A and 23B are views showing modified examples of the arrangement of the host device and the extension units.
Figure 23B:
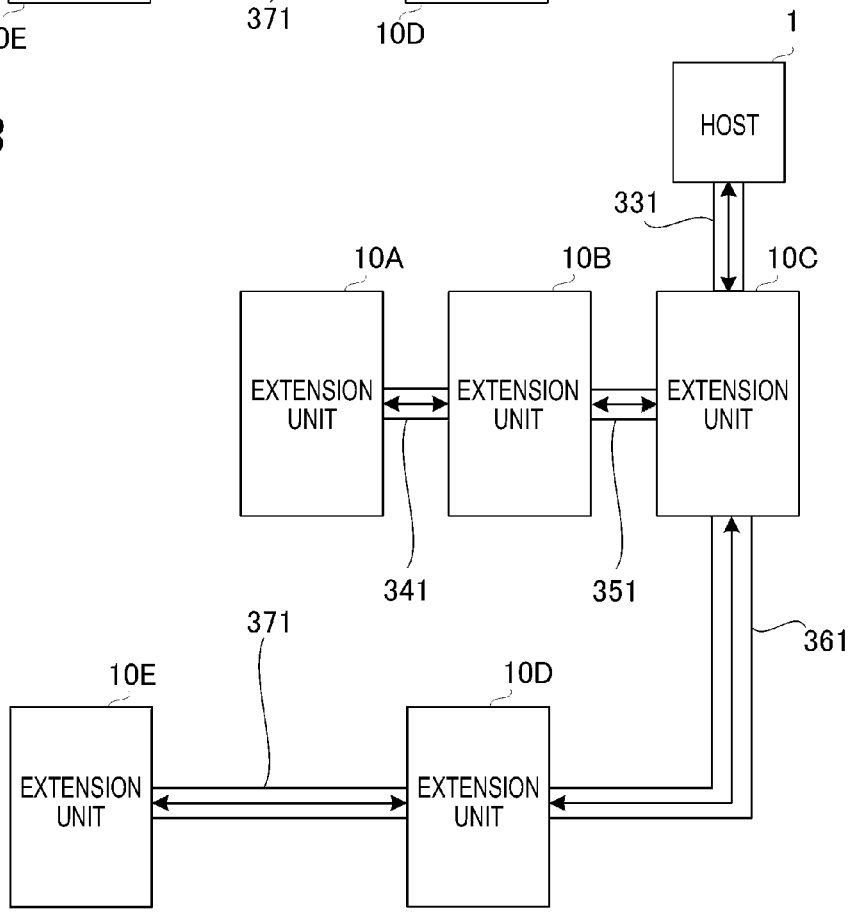

FIGS. 23A and 23B are views showing modification examples relating to the arrangement of the host device and the extension units. Although the connection mode shown in FIG. 23A is the same as that shown in FIG. 12, the extension unit 10C is located farthest from the host device 1 and the extension unit 10E is located closest the host device 1 in this example. In other words, the cable 361 connecting the extension unit 10C to the extension unit 10D is bent so that the extension units 10D and 10E are located closer to the host device 1.

On the other hand, in the example shown in FIG. 23B, the extension unit 10C is connected to the host device 1 via the cable 331. In this case, at the extension unit 10C, the data transmitted from the host device 1 is branched and transmitted to the extension unit 10B and the extension unit 10D. In addition, the extension unit 10C transmits the data transmitted from the extension unit 10B and the data transmitted from the extension unit 10D altogether to the host device 1. Even in this case, the host device is connected to either one of the plurality of extension units connected in series.

Here, the above embodiments are summarized as follows.

There is provided a signal processing system according to the present invention, comprising:

a plurality of microphone units configured to be connected in series;

each of the microphone units having a microphone for picking up sound, a temporary storage memory, and a processing section for processing the sound picked up by the microphone;

a host device configured to be connected to one of the microphone units, the host device having a non-volatile memory in which a sound signal processing program for the microphone units is stored;

the host device transmitting the sound signal processing program read from the non-volatile memory to each of the microphone units; and each of the microphone units temporarily storing the sound signal processing program in the temporary storage memory, wherein the processing section performs a process corresponding to the sound signal processing program temporarily stored in the temporary storage memory and transmits the processed sound to the host device.

As described above, in the signal processing system, no operation program is stored in advance in the terminals (microphone units), but each microphone unit receives a program from the host device and temporarily stores the program and then performs operation. Hence, it is not necessary to store numerous programs in the microphone unit in advance. Furthermore, in the case that a new function is added, it is not necessary to rewrite the program of each microphone unit. The new function can be achieved by simply modifying the program stored in the non-volatile memory on the side of the host device.

In the case that a plurality of microphone units are connected, the same program may be executed in all the microphone units, but an individual program can be executed in each microphone unit.

For example, in the case that a speaker is provided in the host device, it may be possible to use a mode in which an echo canceller program is executed in the microphone unit located closest to the host device, and a noise canceller program is executed in the microphone unit located farthest from the host device is executed. In the signal processing system according to the present invention, even if the connection positions of the microphone units are changed, a program suited for each connection position is transmitted. For example, the echo canceller program is surely executed in the microphone unit located closest to the host device. Hence, the user is not required to be conscious of which microphone unit should be connected to which position.

Moreover, the host device can modify the program to be transmitted depending on the number of microphone units to be connected. In the case that the number of the microphone units to be connected is one, the gain of the microphone unit is set high, and in the case that the number of the microphone units to be connected is plural, the gains of the respective microphone units are set relatively low.

On the other hand, in the case that each microphone unit has a plurality of microphones, it is also possible to use a mode in which a program for making the microphones to function as a microphone array is executed.

In addition, it is possible to use a mode in which the host device creates serial data by dividing the sound signal processing program into constant unit bit data and by arranging the unit bit data in the order of being received by the respective microphone units, transmits the serial data to the respective microphone units; each microphone unit extracts the unit bit data to be received by the microphone unit from the serial data and receives and temporarily store the extracted unit bit data; and the processing section performs a process corresponding to the sound signal processing program obtained by combining the unit bit data. With this mode, even if the number of programs to be transmitted increases because of the increase in the number of the microphone units, the number of the signal lines among the microphone units does not increase.

Furthermore, it is also possible to use a mode in which each microphone unit divides the processed sound into constant unit bit data and transmits the unit bit data to the microphone unit connected as the higher order unit, and the respective microphone units cooperate to create serial data to be transmitted, and the serial data is transmitted to the host device. With mode, even if the number of channels increases because of the increase in the number of the microphone units, the number of the signal lines among the microphone units does not increase.

Moreover, it is also possible to use a mode in which the microphone unit has a plurality of microphones having different sound pick-up directions and a sound level detector, the host device has a speaker, the speaker emits a test sound wave toward each microphone unit, and each microphone unit judges the level of the test sound wave input to each of the plurality of the microphones, divides the level data serving as the result of the judgment into constant unit bit data and transmits the unit bit data to the microphone unit connected as the higher order unit, whereby the respective microphone units cooperate to create serial data for level judgment. With this mode, the host device can grasp the level of the echo in the range from the speaker to the microphone of each microphone unit.

What' more, it is also possible to use a mode in which the sound signal processing program is formed of an echo canceller program for implementing an echo canceller, the filter coefficients of which are renewed, the echo canceller program has a filter coefficient setting section for determining the number of the filter coefficients, and the host device changes the number of the filter coefficients of each microphone unit on the basis of the level data received from each microphone unit, determines a change parameter for changing the number of the filter coefficients for each microphone unit, creates serial data by dividing the change parameter into constant unit bit data and by arranging the unit bit data in the order of being received by the respective microphone units, and transmits the serial data for the change parameter to the respective microphone units.

In this case, it is possible that the number of the filter coefficients (the number of taps) is increased in the microphone units located close to the host device and having high echo levels and that the number of the taps is made decreased in the microphone units located away from the host device and having low echo levels.

Still further, it is also possible to use a mode in which the sound signal processing program is the echo canceller program or the noise canceller program for removing noise components, and the host device determines the echo canceller program or the noise canceller program as the program to be transmitted to each microphone unit depending on the level data.

In this case, it is possible that the echo canceller is executed in the microphone units located close to the host device and having high echo levels and that the noise canceller is executed in the microphone units located away from the host device and having low echo levels.

There is also provided a signal processing method for a signal processing system having a plurality of microphone units connected in series and a host device connected to one of the microphone units, wherein each of the microphone units has a microphone for picking up sound, a temporary storage memory, and a processing section for processing the sound picked up by the microphone, and wherein the host device has a non-volatile memory in which a sound signal processing program for the microphone units is stored, the signal processing method comprising:

reading the sound signal processing program from the non-volatile memory by the host device and transmitting the sound signal processing program to each of the microphone units when detecting a startup state of the host device;

temporarily storing the sound signal processing program in the temporary storage memory of each of the microphone units; and performing a process corresponding to the sound signal processing program temporarily stored in the temporary storage memory and transmitting the processed sound from each of the microphone units to the host device.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2012-248158 filed on Nov. 12, 2012, Japanese Patent Application No. 2012-249607 filed on Nov. 13, 2012, and Japanese Patent Application No. 2012-249609 filed on Nov. 13, 2012, the contents of which are incorporated herein by reference.

What is claimed is:

1. A signal processing system comprising:

a plurality of microphone units configured to be connected in series;

each of the plurality of microphone units having a microphone for picking up sound, a temporary storage memory, and a processing section for processing the sound picked up by the microphone;

a host device configured to be connected to at least one of the microphone units, the host device having a non-volatile memory in which a sound signal processing program for the microphone units is stored;

the host device configured to transmit the sound signal processing program read from the non-volatile memory to each of the plurality of microphone units; and each of the plurality of microphone units configured to temporarily store the sound signal processing program in the temporary storage memory, wherein the processing section performs a process corresponding to the sound signal processing program temporarily stored in the temporary storage memory and transmits the processed sound to the host device.

2. The signal processing system according to claim 1, wherein the host device creates serial data by dividing the sound signal processing program into constant unit bit data and by arranging the unit bit data in the order of being respectively received by the microphone units, and transmits the serial data to each of the plurality of microphone units;

wherein each of the plurality of microphone units extracts the unit bit data to be received by the microphone unit from the serial data and receives and temporarily stores the extracted unit bit data; and wherein the processing section performs a process corresponding to the sound signal processing program obtained by combining the unit bit data.

3. The signal processing system according to claim 1, wherein each of the plurality of microphone units divides the processed sound into constant unit bit data and transmits the unit bit data to the microphone unit connected as the higher order unit, and the microphone units respectively cooperate to create serial data to be transmitted, and the serial data is transmitted to the host device.

4. The signal processing system according to claim 1, each of the plurality of microphone units including a plurality of microphones having different sound pick-up directions and a sound level detector;

the host device having a speaker; and the speaker configured to emit a test sound wave toward each of the plurality of microphone units, wherein each of the plurality of microphone units judges the level of the test sound wave input to each of the plurality of microphones, divides the level data serving as a result of the judgment into constant unit bit data and transmits the unit bit data to the microphone unit connected as the higher order unit, whereby the microphone units respectively cooperate to create serial data for level judgment.

5. The signal processing system according to claim 1, wherein the sound signal processing program is formed of an echo canceller program for implementing an echo canceller, filter coefficients of which are renewed, the echo canceller program has a filter coefficient setting section for determining the number of the filter coefficients; and wherein the host device changes the number of the filter coefficients of each of the plurality of microphone units based on the level data received from each of the plurality of microphone units, determines a change parameter for changing the number of the filter coefficients for each of the plurality of microphone units, creates serial data by dividing the change parameter into constant unit bit data and by arranging the unit bit data in the order of being respectively received by the microphone units, and transmits the serial data for the change parameter to the microphone units respectively.

6. The signal processing system according to claim 5, wherein the sound signal processing program is the echo canceller program or a noise canceller program for removing noise components; and wherein the host device determines the echo canceller program or the noise canceller program as the program to be transmitted to each of the plurality of microphone unit based on the level data.

7. A signal processing method for a signal processing system having a plurality of microphone units connected in series and a host device connected to at least one of the microphone units, each of the plurality of microphone units having a microphone for picking up sound, a temporary storage memory, and a processing section for processing the sound picked up by the microphone, and the host device having a non-volatile memory in which a sound signal processing program for the microphone units is stored, the signal processing method comprising:

reading the sound signal processing program from the non-volatile memory by the host device and transmitting the sound signal processing program to each of the plurality of microphone units when detecting a startup state of each of the plurality of microphone units;

temporarily storing the sound signal processing program in the temporary storage memory of each of the plurality of microphone units; and performing a process corresponding to the sound signal processing program temporarily stored in the temporary storage memory and transmitting the processed sound from each of the plurality of microphone units to the host device.

8. The signal processing method according to claim 7, wherein the host device creates serial data by dividing the sound signal processing program into constant unit bit data and by arranging the unit bit data in the order of being respectively received by the microphone units, and transmits the serial data to each of the plurality of microphone units;

wherein each of the plurality of microphone units extracts the unit bit data to be received by the microphone unit from the serial data and receives and temporarily stores the extracted unit bit data; and wherein the processing section performs a process corresponding to the sound signal processing program obtained by combining the unit bit data.

9. The signal processing method according to claim 7, wherein each of the plurality of microphone units divides the processed sound into constant unit bit data and transmits the unit bit data to the microphone unit connected as the higher order unit, and the microphone units respectively cooperate to create serial data to be transmitted, and the serial data is transmitted to the host device.

10. The signal processing method according to claim 7, each of the plurality of microphone units including a plurality of microphones having different sound pick-up directions and a sound level detector;

the host device having a speaker; and the speaker configured to emit a test sound wave toward each of the plurality of microphone units, wherein each of the plurality of microphone units judges the level of the test sound wave input to each of the plurality of microphones, divides the level data serving as a result of the judgment into constant unit bit data and transmits the unit bit data to the microphone unit connected as the higher order unit, whereby the microphone units respectively cooperate to create serial data for level judgment.

11. The signal processing method according to claim 7, wherein the sound signal processing program is formed of an echo canceller program for implementing an echo canceller, filter coefficients of which are renewed, the echo canceller program has a filter coefficient setting section for determining the number of the filter coefficients; and wherein the host device changes the number of the filter coefficients of each of the plurality of microphone units based on the level data received from each of the plurality of microphone units, determines a change parameter for changing the number of the filter coefficients for each of the plurality of microphone units, creates serial data by dividing the change parameter into constant unit bit data and by arranging the unit bit data in the order of being respectively received by the microphone units, and transmits the serial data for the change parameter to the microphone units respectively.

12. The signal processing method according to claim 11, wherein the sound signal processing program is the echo canceller program or a noise canceller program for removing noise components; and wherein the host device determines the echo canceller program or the noise canceller program as the program to be transmitted to each of the plurality of microphone unit based on the level data.

* * * * *